US005746543A

United States Patent [19]

Leonard

[11] Patent Number: 5,746,543

[45] Date of Patent: May 5, 1998

[54] VOLUME CONTROL MODULE FOR USE IN DIVING

[76] Inventor: Kenneth J. Leonard, 13507 Riverton Dr., Midlothian, Va. 23113

[21] Appl. No.: 699,737

[22] Filed: Aug. 20, 1996

[51] Int. Cl.[6] ..... B63C 11/02; B63C 11/26

[52] U.S. Cl. ..... 405/186; 114/315; 441/96

[58] Field of Search ..... 405/185, 186; 114/315, 317; 441/96

[56] References Cited

U.S. PATENT DOCUMENTS

| | | | |
|---|---|---|---|
| 3,487,647 | 1/1970 | Brecht, Jr. | 405/186 |
| 3,820,348 | 6/1974 | Fast | 405/186 |
| 3,866,253 | 2/1975 | Sinks et al. | 405/186 |
| 3,992,948 | 11/1976 | D'Antonio et al. | 73/865.1 |
| 4,005,282 | 1/1977 | Jennings | 73/865.1 |
| 4,060,076 | 11/1977 | Botos et al. | 128/204.29 |
| 4,068,389 | 1/1978 | Staffin et al. | 34/582 |
| 4,068,657 | 1/1978 | Kobzan | 128/202.14 |
| 4,114,389 | 9/1978 | Bohmrich et al. | 405/186 |
| 4,137,585 | 2/1979 | Wright, III | 405/193 |
| 4,324,507 | 4/1982 | Harrah | 405/186 |
| 4,876,903 | 10/1989 | Budinger | 73/865.1 |
| 4,882,678 | 11/1989 | Hollis et al. | 73/865.1 |
| 4,951,698 | 8/1990 | Grosso | 137/81.2 |
| 5,007,364 | 4/1991 | Buckle | 114/331 |
| 5,482,405 | 1/1996 | Tolksdorf et al. | 405/186 |
| 5,496,136 | 3/1996 | Egan | 405/186 |
| 5,542,446 | 8/1996 | Rose | 137/81.2 |
| 5,551,800 | 9/1996 | Hobelsberger | 405/186 |

FOREIGN PATENT DOCUMENTS

76534/94 3/1995 Australia .

*Primary Examiner*—Tamara L. Graysay
*Assistant Examiner*—Tara L. Mayo
*Attorney, Agent, or Firm*—Reid & Priest L.L.P.

[57] ABSTRACT

A volume control module for controlling the volume of a fluid such as air in a buoyancy chamber of a buoyancy compensator device comprises a main unit and a selector pad. The main unit includes a main unit housing having a first opening connectable to the buoyancy compensator device and a second opening connectable to an inflator hose assembly. Three pressure sensors, a microprocessing unit, and intake and vent valves are provided in the main unit housing. A first pressure sensor measures ambient pressure; a second measures the pressure inside the buoyancy chamber; and a third measures the air pressure entering the intake valve. The microprocessing unit carries out a variety of buoyancy-control functions responsive to output signals from the pressure sensors. The intake and vent valves are both controlled by the microprocessing unit and are both normally closed. The intake valve is connectable to a source of low pressure fluid, while the vent valve vents fluid from the buoyancy chamber. A manual emergency cutoff switch on the main unit housing can deactivate the microprocessing unit and the first and second valves. An unobstructed first main passage in the main unit housing extends between the first and second openings of the main unit housing. A second main passage extends between the vent valve and the first opening of the main unit housing, and is fluidly connected with the intake valve. An intake passageway in the main unit housing fluidly connects the intake valve with the second main passage. The selector pad connected to the microprocessing unit includes switches for selecting a microprocessing unit function.

44 Claims, 19 Drawing Sheets

VOLUME CONTROL MODULE FOR USE IN DIVING

BACKGROUND OF THE INVENTION

1. Field of the Invention

The present invention relates to buoyancy compensator apparatus for diving. More specifically, the invention relates to a module for controlling the air volume within the chamber of such buoyancy compensator apparatus.

2. Related Art

In order to control their buoyancy, divers presently wear a buoyancy compensator vest. The diver controls his or her buoyancy by manually adding air to and venting air from a chamber in the vest. There is presently no piece of equipment on the market which permits the diver to perform these operations automatically.

In presently-available equipment, the diver is not able to precisely control the volume of air in the buoyancy chamber. The intake and vent valves do not control the air flow in known volumes. The diver simply guesses, based on training, practice, and experience, for how long to open the control valves. The current manual control therefore requires repetitive training, constant practice, and the constant awareness and attention on the diver's part. It is by its very nature imprecise, and can cause the diver to lose control.

One example of prior art equipment is the Nautilus, manufactured in the 1970's by Dacor, and believed to be described in U.S. Pat. No. 4,068,389 to Kobzan and U.S. Pat. No. 4,114,389 to Bohmrich et al. This device had a hard shell buoyancy chamber resistant to the effect of pressure changes. It did not determine the volume of the chamber; the diver was responsible for making this determination. The Nautilus was able to maintain a substantially constant volume in the chamber as the diver changed depth, because of the minimal effect of pressure on the hard shell and a minor pressure control valve.

In both U.S. Pat. No. 4,068,657 to Kobzan and U.S. Pat. No. 4,114,389 to Bohmrich et al., the buoyancy is regulated by manually-operated valves. Water is permitted to enter the buoyancy chamber in order to decrease the buoyancy of the diver.

U.S. Pat. No. 3,487,647 to Brecht discloses a buoyancy control device for SCUBA apparatus having control buttons for up, down, and constant depth (see column 8, lines 10–51). Control of the valves is accomplished mechanically and requires judgment of the diver.

U.S. Pat. No. 4,324,507 to Harrah discloses an automatically-controlled buoyancy vest in which the diver controls buoyancy by adjusting a knob that is connected to a spring-loaded bladder. Similarly, U.S. Pat. No. 3,820,348 to Fast discloses buoyancy regulating apparatus in which a manually operated control yoke is used to regulate pressure in air bladders.

U.S. Pat. No. 4,137,585 to Wright and U.S. Pat. No. 3,866,253 to Sinks et al. disclose various other, manually-operated buoyancy compensating vests.

U.S. Pat. Nos. 4,876,903 to Budinger; 3,992,948 to D'Antonio et al.; 4,882,678 to Hollis et al.; 4,060,076 to Botos et al.; and 4,005,282 to Jennings disclose various computerized means of monitoring conditions. None of these patents teaches or suggests the application of computerized monitoring to buoyancy control.

None of the prior art devices provide accurate, automatic buoyancy control, use of a microprocessor to maintain buoyancy control, achieve neutral buoyancy, or avoid the need for the diver to monitor chamber volume. It is to the solution of these and other problems to which the present invention is directed.

SUMMARY OF THE INVENTION

It is therefore a primary object of the present invention to provide a volume control device for use in diving which enables a diver to control his or her buoyancy automatically.

It is another object of the present invention to provide a volume control device for use in diving which enables a diver to control his or her buoyancy by selecting the correct control choice.

It is still another object of the present invention to provide a volume control device for use in diving which monitors and adjusts the volume of the buoyancy chamber as needed to maintain the desired buoyancy.

It is still another object of the present invention to provide a volume control device for use in diving which calculates the buoyancy chamber volume needed to attain the desired control choice, then controls valves precisely to attain that volume.

These and other objects of the invention are achieved by the provision of a volume control module for controlling the volume of fluid in a buoyancy chamber of a buoyancy compensator device such as a buoyancy compensator vest. The volume control module comprises a main unit housing having a first opening connectable to a buoyancy compensator device and a second opening connectable to an inflator hose assembly. Three pressure sensors, a microprocessing unit, and intake and exhaust valves are provided in the main unit housing.

A first pressure sensor measures ambient pressure, and generates an output signal which is received by the microprocessing unit. A second pressure sensor measures the pressure inside the buoyancy chamber of the vest. A third pressure sensor measures the air pressure entering the intake valve. Preferably, all three pressure sensors are pressure transducers. Alternatively, a pressure switch can be used in place of the third pressure sensor. The microprocessing unit is programmed to carry out a variety of buoyancy-control functions and is responsive to the output signals of the pressure sensors.

The intake and exhaust valves are both controlled by the microprocessing unit. The intake valve is configured for connection to a source of low pressure fluid, while the exhaust valve exhausts fluid from the buoyancy chamber of the vest into the surrounding water. The intake and exhaust valves are both changeable between open and closed conditions, the intake and exhaust valves are both normally in the closed condition, and the intake and exhaust valves are selectively openable based on the function being performed by the microprocessing unit.

A manual emergency cutoff switch is positioned on the exterior of the main unit housing in an easily accessible location to enable manual deactivation of the microprocessing unit and the first and second valves.

In one aspect of the invention, a tone generator is provided in the main unit housing which is responsive to output signals from the microprocessing unit for generating audible messages relating to the functions being performed by the microprocessing unit.

The main unit housing is also provided with first and second main passages. The first main passage in the main unit housing extends between the first and second openings of the main unit housing, and is unobstructed. The second main passage extends between the exhaust valve and the first opening of the main unit housing, and also is in fluid communication with the intake valve. An intake passageway in the main unit housing preferably is provided for fluid connecting the intake valve with the second main passage.

A power source is encased in the main unit housing and is electrically connected to the microprocessing unit, the first and second valves, and the three pressure sensors to provide power to those elements of the volume control module.

The main unit housing, microprocessing unit, intake and exhaust valves, pressure sensors, emergency cut-off switch, tone generator, first and second main passageways, and intake passageway together comprise a main unit of the volume control module.

A switch mechanism allows selection of the functions to be carried out by the microprocessing unit. Preferably, the switch mechanism comprises a plurality of switches encased in a selector pad housing, and an electrical cable extends from the selector pad housing to the main unit housing for electrically connecting the switches to the microprocessing unit.

In another aspect of the invention, first and second connectors are provided at the first and second openings, respectively, of the main unit housing. The first connector is compatible with a connector on the buoyancy compensator device, while the second connector is compatible with a connector on the inflator hose assembly.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
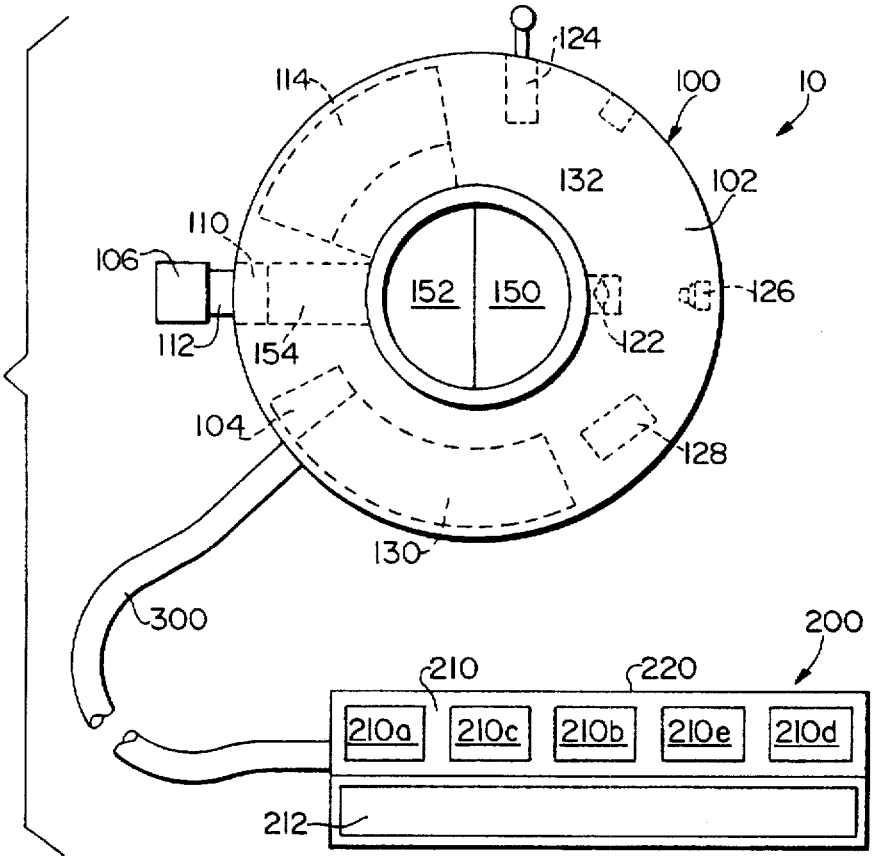
FIG. 1 is a top plan view of a volume control module in accordance with the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
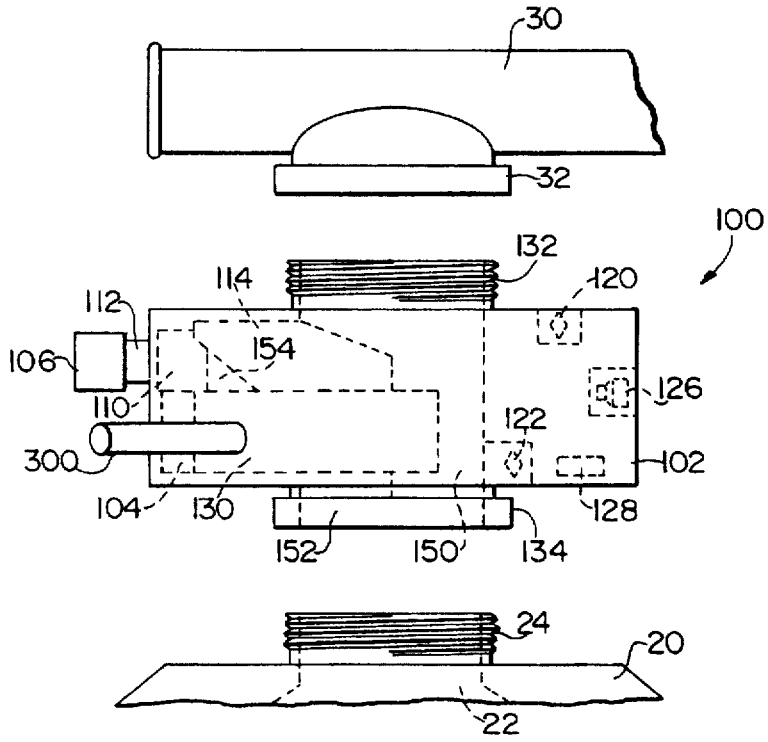
FIG. 2 is an exploded, side elevational view of the main unit of the volume control module of FIG. 1 in association with a buoyancy compensator vest and the inflation hose assembly of the vest.

Referring now to FIGS. 1 and 2, there is shown a volume control module 10 in accordance with the present invention. A basic function of the volume control module 10 is to control the buoyancy of a diver by controlling the volume of air in the buoyancy chamber 22 of a buoyancy compensator vest 20. Alternatively, as will be appreciated by those of skill in the art, the volume control module 10 in accordance with the present invention can be used in conjunction with any piece of underwater equipment provided with an adjustable buoyancy chamber 22, and in particular, in conjunction with remotely operated underwater vehicles and other equipment. In the case of underwater equipment, the volume control module 10 functions by controlling the volume of fluid (which may be oil) in the buoyancy chamber of the underwater equipment.

The volume control module 10 comprises a main unit 100 used to control the inlet and venting of air in the buoyancy chamber 22 and a selector pad 200 connected to main unit 100, used by a diver to select functions to be carried out by the main unit 100. A cable 300 connects the main unit 100 to the selector pad 200. The volume control module 10 is designed so as to not interfere with the normal workings of the existing airflow controls on the vest 20.

The main unit 100 includes a main unit housing 102 having an upper or outwardly facing face **102*a* and a lower or inwardly facing face 102*b*. The heart of the main unit 100 is a microprocessing unit 104 or any other form of electrical circuit capable of performing the necessary determinations and functions described in detail below. A low pressure hose connection 106 at the side of the housing 102 attaches the main unit 100 to the required air source, specifically a conventional low pressure hose (not shown) attached in a conventional manner to the buoyancy compensator vest 20. An intake valve 110 operates to input air from low pressure hose connection 106 through the main unit 100 into the buoyancy chamber 22. An input pressure sensor 112 is interposed between the low pressure hose connection 106 and the intake valve 110 to measure the pressure of the air entering the intake valve 110. A vent or exhaust valve 114 is also provided in housing 102 for exhausting air from the buoyancy chamber 22 through the main unit 100. An external pressure sensor 120 is provided in housing 102 to measure the ambient pressure. An interior pressure sensor 122 is also provided in the housing 102 to provide an accurate measurement of the interior pressure, used to compute the pressure drop across the intake valve 110 and the vent valve 114. Pressure sensors 112, 120, and 122** preferably are pressure transducers, but other mechanisms can also be used.

A manual emergency cutoff switch 124 is prominently positioned on the upper face **102*a* of the housing 102 in an easily accessible location to enable the diver to deactivate manually the entire volume control module 10 at any time and in case of malfunction. Preferably, the emergency cutoff switch 124 will be activated by a pull cord, and will interrupt the power supply from the power source (which is described below). Interruption of the power supply will in turn cause the valves 110 and 114 to close, disabling volume control module 10. The microprocessing unit 104 can be programmed so that the diver will have to surface before it will permit the volume control module 10** to be turned back on.

A tone generator 126 is provided in the housing 102 to indicate to the diver when certain operations are being controlled by the main unit 100. A tilt sensor 128, such as a mercury switch, is also provided in the housing 102, for indicating when the diver is at an angle when the air in the vest 20 is away from the opening 24.

A power source 130, such as a battery, is encased in the housing 102 and provides sufficient power to operate all parts, i.e. the microprocessing unit 104, the intake and vent valves 110 and 114, pressure sensors 112, 120, and 122, the manual emergency cutoff switch 124, the tone generator 126, and the tilt sensor 128, as needed. Preferably, the power source 130 is removable so that it can be replaced as needed.

Alternatively, the power source 130 can be located in the selector pad 200, or can even be attached to the diver. Although the preferred location for the power source 130 is in the main unit 100, the selector pad can encase a larger battery than the housing 102, and therefore would house the power source 130 if a large battery is required.

Figure 3:
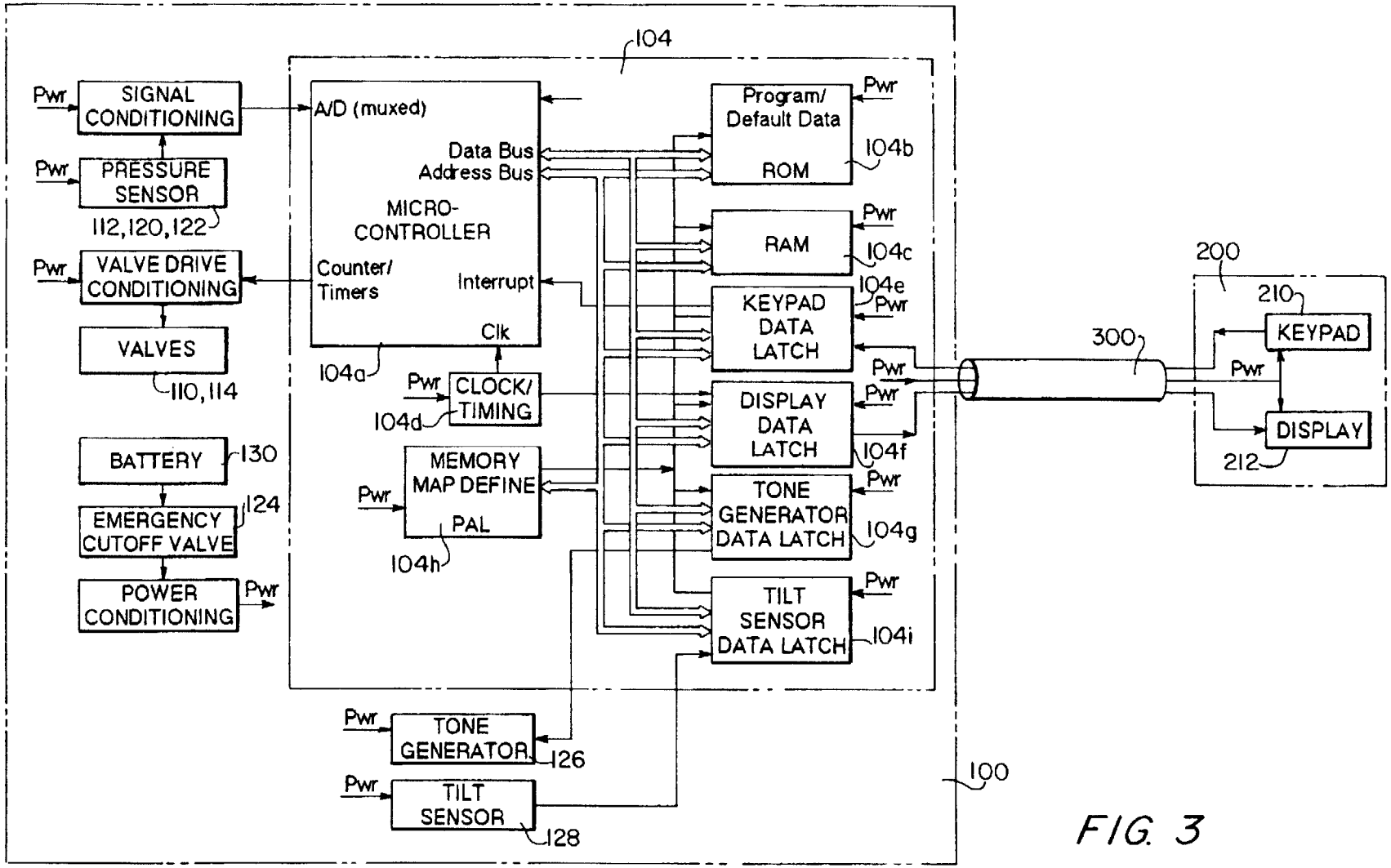
FIG. 3 is a circuit diagram of the volume control module of FIG. 1.

One of ordinary skill in this art will appreciate that, as shown in FIG. 3, the microprocessing unit 104 would necessarily encompass a microprocessor (CPU) 104*a* or other processing module together with one or more memory modules (ROM 104*b*, RAM 104*c*, EPROM, etc.), a clock 104*d* or other precision timer, programming or instructions, and other elements that would typically further require some form of memory, and drivers to operate the tone generator 126 and valves 110 and 114. The microprocessing unit hardware 104, low pressure hose connection 106, intake and vent valves 110 and 114, pressure sensors 112, 120, and 122, cutoff switch 124, the tone generator 126, and the tilt sensor 128 are all of a type generally well known in the art and commercially available from a variety of known vendors.

The main unit 100 is attached to the buoyancy compensator vest 20 by upper and lower threaded connectors 132 and 134 on the upper and lower faces 102*a* and 102*b* of the housing 102. Conventionally, the buoyancy compensator vest 20 has a male threaded connector 24, and the inflator hose assembly 30 which conventionally attaches directly to the buoyancy compensator vest 20 thus has a female threaded connector 32. In order to enable the main unit 100 to be interposed between the buoyancy compensator vest 20 and the inflator hose assembly 30, the upper threaded connector 132 is male and the lower threaded connector 134 is female. Male and female connectors 132 and 134 thus attach the main unit 100 between the inflator hose assembly 30 and the buoyancy vest 20. The male and female threaded connectors 132 and 134 are of the type necessary to provide attachment to the buoyancy chamber 22 and hose assembly 30 when it exists (there has been discussion in the industry about eliminating the hose assembly 30 from the buoyancy vest 20, and no hose assembly would be present if the volume control module 10 were attached to a lift bag; in either of those cases, internal passage 150 (described below) would then be unnecessary and would be eliminated). Due to variations in size in the threaded connectors used in different brands of inflator hose assemblies and buoyancy compensator vests, it may be necessary to provide adapters for male and female connectors 132 and 134. Such adapters are conventional and well within the skill of those in the art.

The main unit 100 has two main internal passages 150 and 152. The first main passage 150 extends between the buoyancy compensator vest 20 and the inflator hose assembly 30 that comes with the buoyancy compensator vest 20. The interior pressure sensor 122 provides a reading of the pressure inside the main unit 100 to be used in calculating the pressure difference across the intake valve 110 and the vent valve 114. Although in the embodiment of the invention illustrated in FIGS. 1 and 2, interior pressure sensor 122 is located in the first main passage 150, it can in fact be located anywhere inside the main unit 100.

The first main passage 150 is not controlled by the microprocessing unit 104 and is unobstructed. This will permit the operation of the manual or power controls that come with the inflator hose assembly 30, so that the vest 20 will operate as though the volume control module 10 were not present. These inflator hose controls will operate regardless of whether the microprocessing unit 104 is operational, as a safety measure so the diver can always override the control module 10.

The second main passage 152 extends between the exhaust valve 114 and the buoyancy compensator chamber 22, and the flow of fluid through the second main passage 152 is controlled by the intake and vent valves 110 and 114. The intake valve 110 communicates with the second main passage 152 through an intake passageway 154.

In operation, the pressure transducers 112, 120, and 122 generate signals, all of which are read by the microprocessing unit 104 at the beginning of each clock cycle. The intake and vent valves 110 and 114 are controlled by the microprocessing unit 104 based on the function selected by the diver through the selector pad 200, to allow passage of a measured volume of air. The intake and vent valves 110 and 114 will be in the closed position when not powered through microprocessing unit 104. It would be preferable to make an actual measurement of the volume of air passing through the valves 110 and 114. The measuring device necessary to make this measurement would have to be relatively compact; and because the buoyancy chamber commonly contains some water, it would also have to be unaffected by the moisture content of the air. In the absence of a practical measuring device which is sufficiently compact and is unaffected by moisture, the volume of air passing through the valves 110 and 114 can be computed based on the known variables, as described in greater detail below.

The unit 100 will also have an automatic activation and shutoff. It is common practice for an underwater electronic gauge to turn on automatically when the diver enters the water, and shut off after the diver has been out of the water for a time period. This automatic activation and shutoff conserves battery life and avoids the diver forgetting to turn the gauge on or off. Conventional automatic activation and shutoff systems most often operate by sensing the electrical conductivity of water. The automatic activation and shutoff of the present invention can be of the conventional type, based on electrical conductivity. Alternatively, it can be accomplished using a pressure transducer which senses water pressure.

Referring to FIG. 1, the selector pad 200 is shown connected to the main unit 100 by the cable 300. The selector pad 200 has a keypad 210 which shows the diver his or her choices and indicates to the microprocessing unit 104 which selection the diver has chosen. This tells the microprocessing unit 104 which program to use in controlling the buoyancy chamber volume. The keypad 210 has a switch for each selection, a display 212 for displaying information to the diver, a housing 220 for the keypad 210 and the display 212, and as previously described, a cable 300 to connect the selector pad 200 to the main unit 100.

As shown in FIG. 1, the keypad 210 is provided with switches 210*a*, 210*b*, 210*c*, 210*d*, and 210*e* for the following respective selections: SUSPEND (INTERRUPT), SET NEUTRAL BUOYANCY, MAINTAIN NEUTRAL BUOYANCY, MAINTAIN DEPTH, and ASCEND. Only one switch at a time is allowed to be activated. The ASCEND switch 210*e* must be continuously pushed to operate, while the other switches 210*a*–210*d* are simply pushed once to select their corresponding function.

Referring now to FIG. 3, there is shown a circuit diagram of the volume control module 10, illustrating the interconnection between the different electronic elements of the volume control module 10. Electrical power from the battery 130 is supplied to the power conditioning element (not numbered) which in turn supplies power to the various electrical elements of the volume control module 10 (e.g., the valves 110 and 114, the pressure sensors 112, 120, and 122, the tone generator 126, the tilt sensor 128, the cable 300, and the various elements of the microprocessing unit 104, including microcontroller 104*a*, ROM 104*b*, RAM 104*c*, clock 104*d*, keypad data latch 104*e*, display data latch 104*f*, tone generator data latch 104*g*, memory map list 104*h*, and tilt sensor data latch 104*i*) to supply power to them. Signals from the pressure sensors 112, 120, and 122 are subject to conventional signal conditioning prior to being input to the microcontroller 104*a* through an A/D converter. The microcontroller 104*a*, acting through conventional valve drive conditioning, controls the opening and closing of the valves 110 and 114. Power to the keypad 210 and display 212 and signals between the keypad 210 and display 212 and their respective keypad and display data latches, 104*e* and 104*f*, are transmitted through the cable 300. The emergency cut-off switch 124 is interposed between the battery 130 and the power conditioning to cut off power from the battery 130 to the various electrical elements of the volume control module 10 and the selector pad 200.

As mentioned above, due to safety considerations, this invention is designed so as to not to inhibit the working of the existing airflow controls on the vest 20. Regardless of the performance capability of the volume control module 10, the diver will always have the capability to add or vent air manually from the vest 20. The diver will have the ability to operate the existing airflow controls even while the module 10 is operating. Such an action would affect the correct operation of the module 10, as the module 10 does not compensate for the changes to buoyancy chamber volume the diver has made. To maintain accurate control of the buoyancy chamber volume, the diver cannot operate both the manual controls and the module 10 at the same time. To deactivate the module 10, the diver can use the SUSPEND switch 210*a*, or the emergency cut-off switch 124.

The functions or selections from the selector pad 200 each have their own software program (illustrated diagrammatically in FIGS. 4A–4P) to control the vest accordingly. Although the selections are illustrated in FIG. 1 as SUSPEND, SET NEUTRAL BUOYANCY, MAINTAIN NEUTRAL BUOYANCY, MAINTAIN DEPTH, and ASCEND, switches 210 are not limited to these selections, as will be appreciated by those of skill in the art.

When the unit 100 is first activated, all parameters are initialized in step 1010, with the values shown in Table I. These parameters include DEPTH, ASCENT, GET-NB, and MAINTAIN flags, timers, and volume and depth records. The settings of the different flags indicate their states, as shown in Table II. Immediately following initialization of parameters in step 1010, the program pauses at step 1020 for the next clock cycle.

TABLE I

| Initialization of Parameters |
|---|
| Set DEPTH flag = 0 |
| Set ASCENT flag = 0 |
| Set GET-NB flag = 0 |
| Set MAINTAIN flag = 0 |
| Set $NB_1$ TIME = 10 |
| Set $NB_2$ TIME = 10 |
| Set TARGET ASCENT RATE = 30 feet/minute |
| Set FILL PRESSURE MIN = 100 psi |
| Set NB OFFSET DEPTH = 5 feet |
| Set NB-ADD = 0 |
| Set BC-VOL = 0 |
| Set GET-NB TIMER = 0 |
| Set MAINTAIN TIMER = 0 |

TABLE I-continued

| Initialization of Parameters |
|---|
| Set SHALLOW DEPTH = 5 feet |
| Clear MAINTAIN VOLUME RECORD |
| Clear PREV DEPTH RECORD |
| Clear PREV BC-VOL RECORD |
| Clear TARGET DEPTH RECORD |
| Clear GET-NB DEPTH RECORD |

TABLE II

Flag States

| Flag | State |
|---|---|
| DEPTH flag = 0 | OFF |
| DEPTH flag = 1 | ON - ACTIVE |
| ASCENT flag = 0 | OFF |
| ASCENT flag = 1 | ON - ASCENDING TO SURFACE |
| ASCENT flag = 2 | ON - ASCENDING TO 20 FEET |
| ASCENT flag = 3 | ON - MAINTAINING 20 FOOT DEPTH |
| GET-NB flag = 0 | OFF |
| GET-NB flag = 1 | ON - ACTIVE |
| GET-NB flag = 2 | COMPLETED |
| MAINTAIN flag = 0 | OFF |
| MAINTAIN flag = 1 | ON - GETTING NB |
| MAINTAIN flag = 2 | ON - MAINTAINING NB |

At the start of each clock cycle in step 1040, new intake, ambient, and interior pressure readings from sensors 112, 120, and 122, respectively, are provided to the microprocessing unit 104. At the end of each clock cycle, in steps 1730 and 1740, respectively, the previous buoyancy control chamber volume and depth readings are saved for reference and computing during the next clock cycle, as will be described below in connection with steps 1060 and 1070. As will be appreciated by those of skill in the art, the previous buoyancy control chamber volume and depth readings could equally well be saved at the start of each clock cycle, with the taking of the new pressure readings.

In a test model, the clock cycle used was one tenth of a second, or ten hertz. However, as will be appreciated by those of skill in the art, the clock cycle need not be ten hertz. It is important that the clock cycle be short enough to quickly correct the buoyancy chamber volume to avoid a lagging in the controlling function, but long enough to provide time to perform the correction.

Following step 1020, processing continues to step 1030, in which the battery voltage is tested. If the battery voltage is low, then in step 1110, a "low battery" error message is displayed on display 212, and processing returns to step 1010 for initialization of the parameters. Until the battery 130 is replaced, a "low battery" condition will result in processing continuing to loop back to step 1010, and unable to proceed past step 1030. If the battery voltage is adequate, then processing continues to step 1040, for reading of the intake, ambient, and interior pressures from sensors 112, 120, and 122, respectively. Next, the fill pressure (i.e., the minimum amount of air pressure being delivered to the intake valve 110) is examined in step 1050. If the fill pressure is low (i.e., below a minimum value, e.g. 100 psi), then in step 1120, a "low fill pressure" error message is displayed on display 212. As with a "low battery" condition, a "low fill pressure" condition will result in processing continuing to loop back to step 1010, and unable to proceed past step 1050. If the fill pressure is adequate (i.e., above the minimum value), then processing continues to step 1060, for calculation of the depth.

In the next step 1070, the depth calculated in step 1060 is compared to the SHALLOW DEPTH parameter, which in the initialization step 1010 was set to 5 feet. If the calculated depth is less than the "shallow depth" parameter, then in step 1130, a "shallow depth" error message is displayed on display 212, and processing returns to step 1010 for initialization of the parameters. If the depth is greater than the SHALLOW DEPTH parameter, then processing continues to step 1080.

The microprocessing unit 104 determines at step 1080 which program to use, as indicated by the diver's choice on the selector pad 200. If no new selection has been made, the microprocessing unit 104 continues to perform the previous selection (except in the case of the ASCEND selection; the ASCEND switch must be held down to continue selection of the ASCEND function). If the SUSPEND selection is in effect, the microprocessing unit 104 performs the INITIALIZATION OF ALL PARAMETERS at step 1010, then waits for the next cycle. The illustrated selections function as follows.

SUSPEND: This selection interrupts any previous selections at step 1080, and then returns processing to step 1010 to set the initial parameters. The SUSPEND switch does not turn off the volume control module 10. The volume control module 10 remains activated and powered up when the SUSPEND switch 210*a* is selected, but the microprocessing unit 104 performs no actions on the buoyancy chamber volume. The microprocessing unit 104 returns to step 1080 at the next clock cycle to determine whether a new selection has been made.

SET NEUTRAL BUOYANCY ("GET-NB Routine"): This selection causes the main unit 100 to adjust the buoyancy chamber volume to place the diver close to neutral buoyancy. How close is a factor of the amount of time allowed for setting neutral buoyancy and how far from neutral buoyancy the diver is at the start of the process. A diver is exactly at neutral buoyancy when the positive buoyancy of the vest 20 is equal to the negative buoyancy of the diver and his or her equipment. It is noted that the main unit 100 is not able to set the diver at neutral buoyancy if the diver is not negatively buoyant when there is no air contained in the vest 20. This is recognized in the diving art and it is current practice for a diver using a buoyancy vest to become neutrally buoyant, to start the dive at a negative buoyancy.

The microprocessing unit 104 starts the neutral buoyancy cycle by comparing the current depth to the previous depth. If the change in depth per clock cycle is greater then the acceptable range, the microprocessing unit 104 inputs or vents air through intake valve 110 or vent valve 114, respectively, to counter the depth changes. The microprocessor program activated by this selection continues for a pre-set time period $NBT_1$, designated "NBT-1" in the flow diagram. The length of the time period is predetermined before programming the microprocessing unit 104, and will effect the accuracy of the neutral buoyancy setting. It needs to be of sufficient length to provide enough time to get the diver near neutral buoyancy when correcting near the maximum buoyancy chamber volume. It is estimated that $NBT_1$ will be less than ten seconds, but it can be any length. The longer $NBT_1$ is, the closer to neutral buoyancy the final buoyancy will be. When time has expired, the current depth is saved for use in the MAINTAIN NEUTRAL BUOYANCY cycle, described below.

Figure 4:
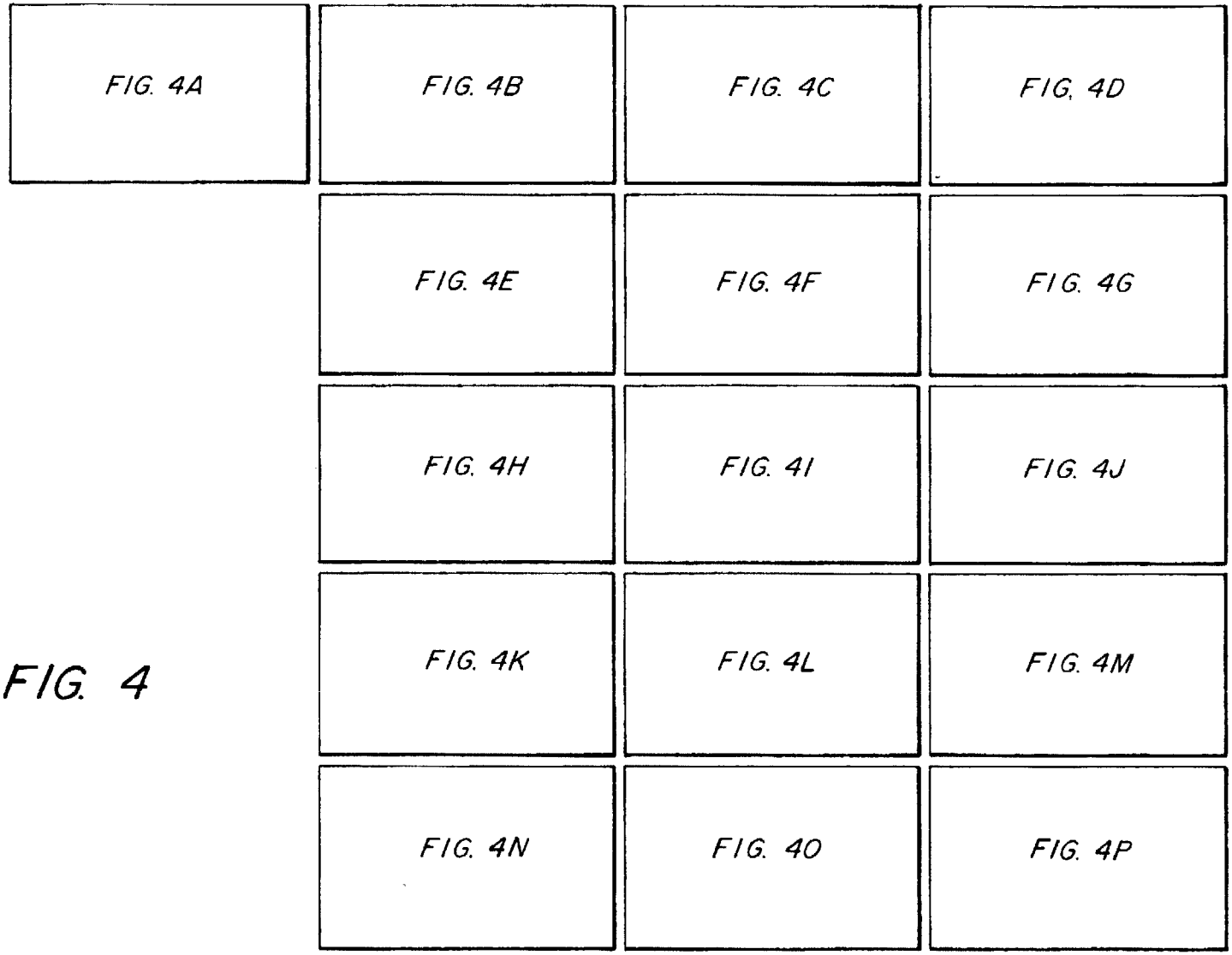
FIG. 4 shows the arrangement of FIGS. 4A–4P.
Figure 4A:
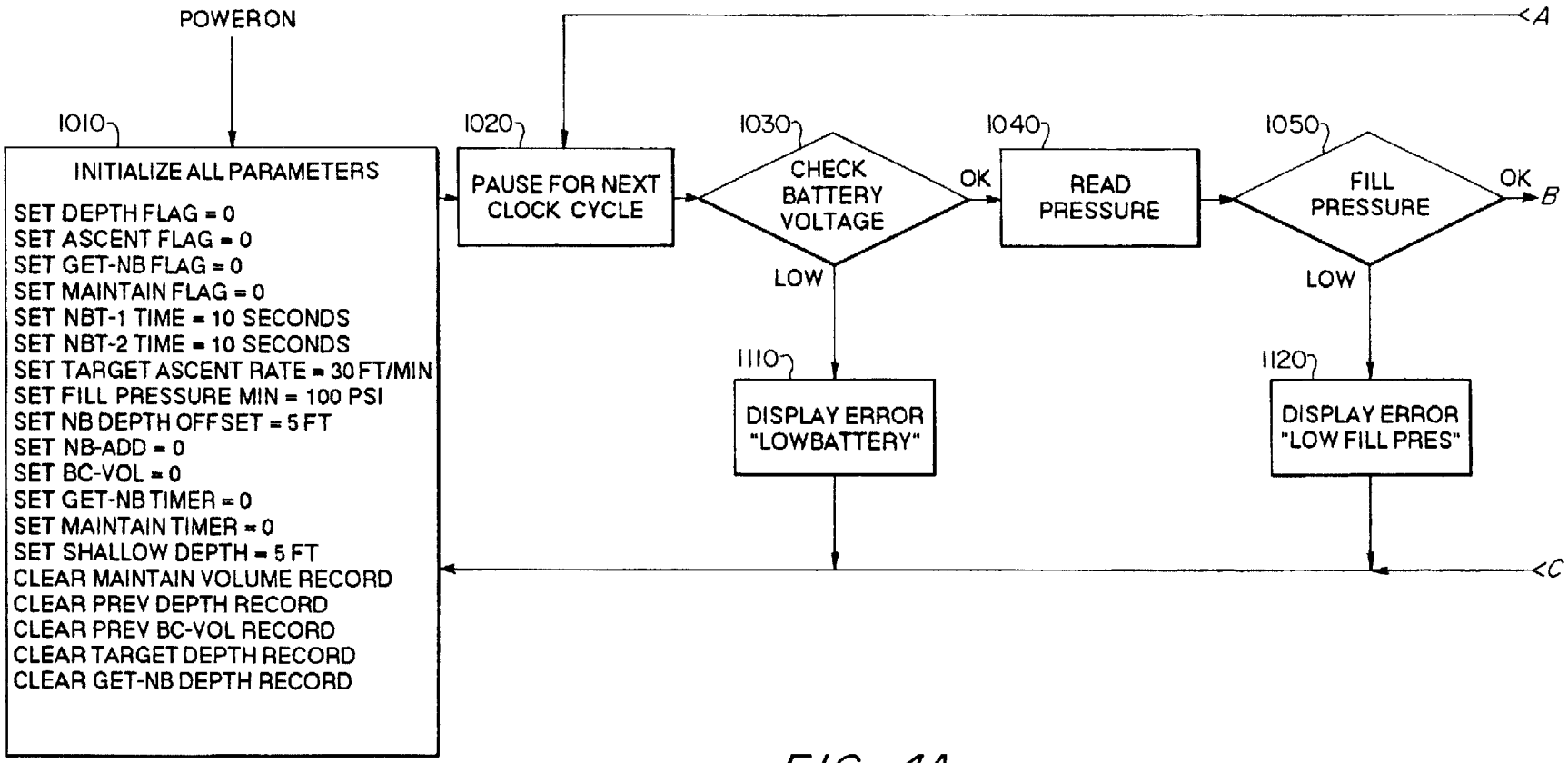
FIGS. 4A–4P represent a diagrammatic view of the microprocessor programming of the volume control module of FIG. 1.
Figure 4B:
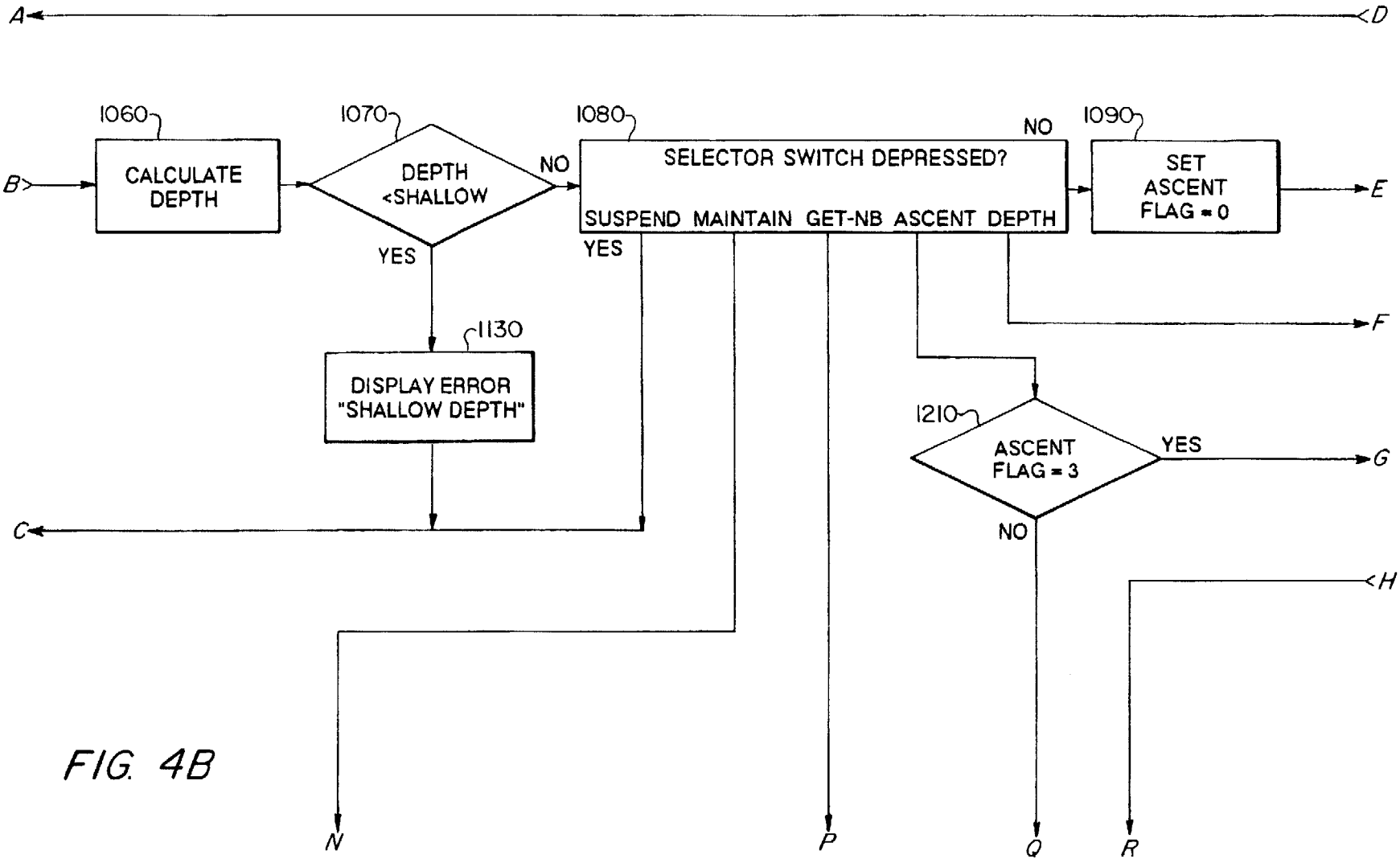
Figure 4C:
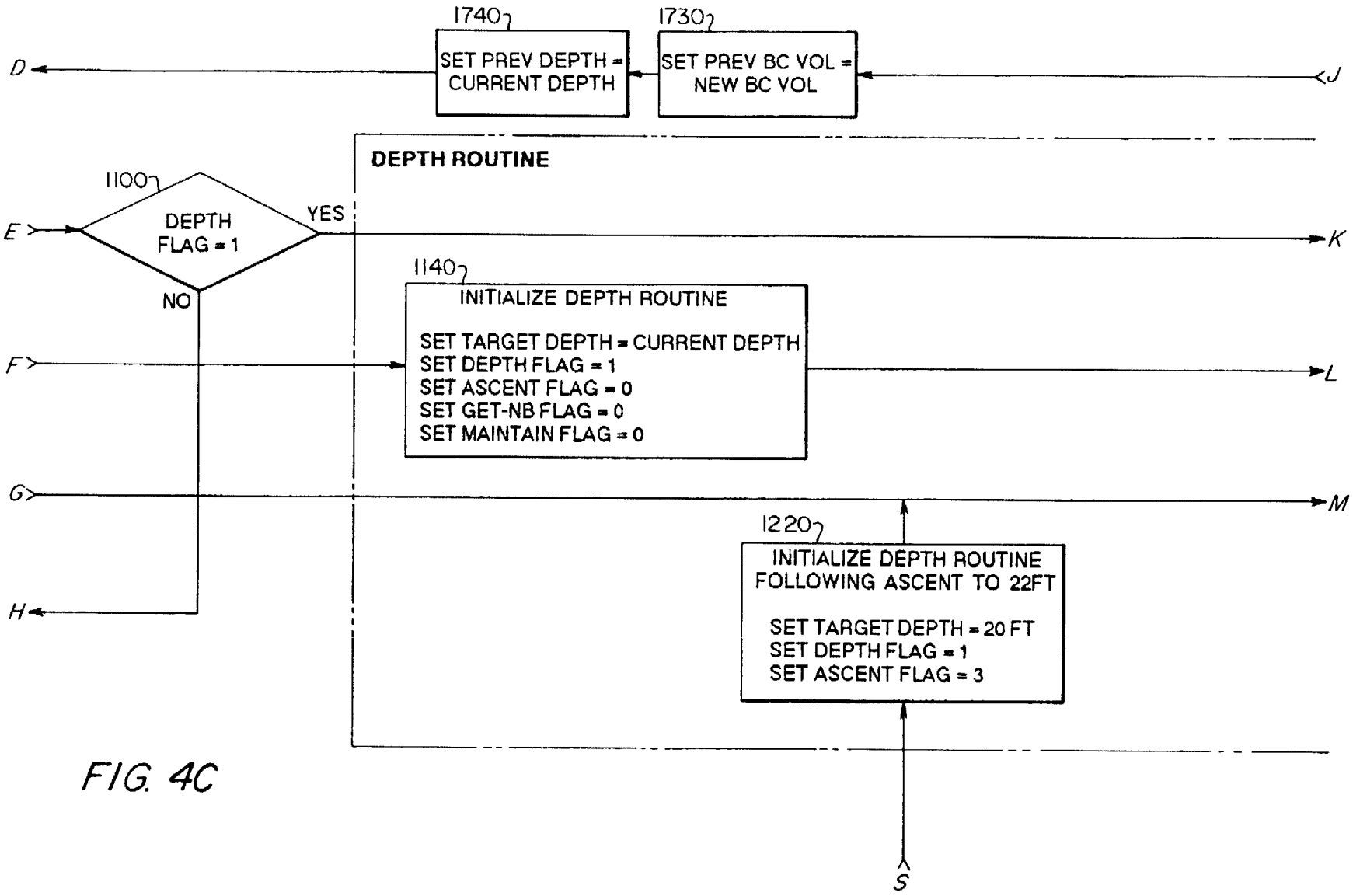
Figure 4D:
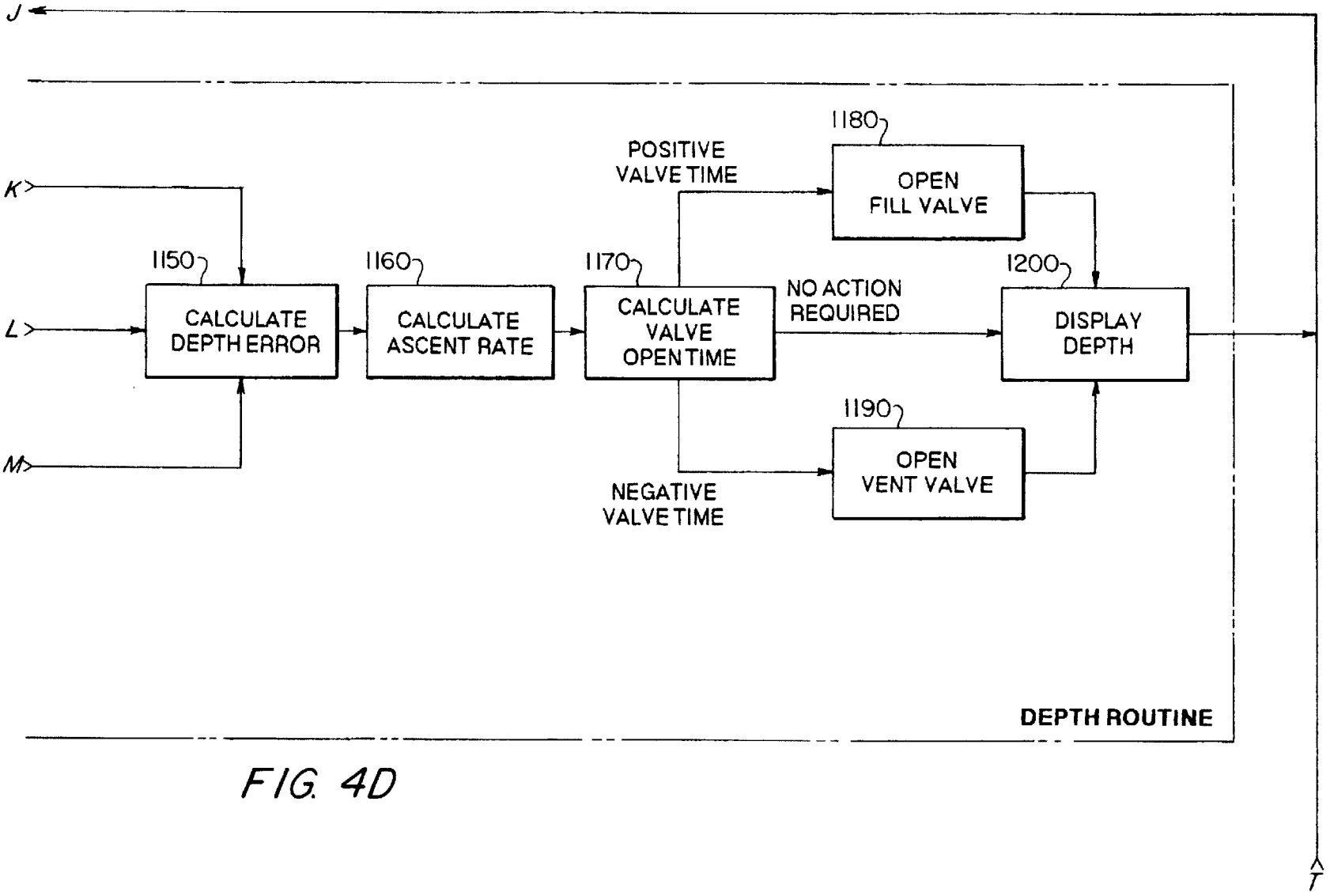
Figure 4E:
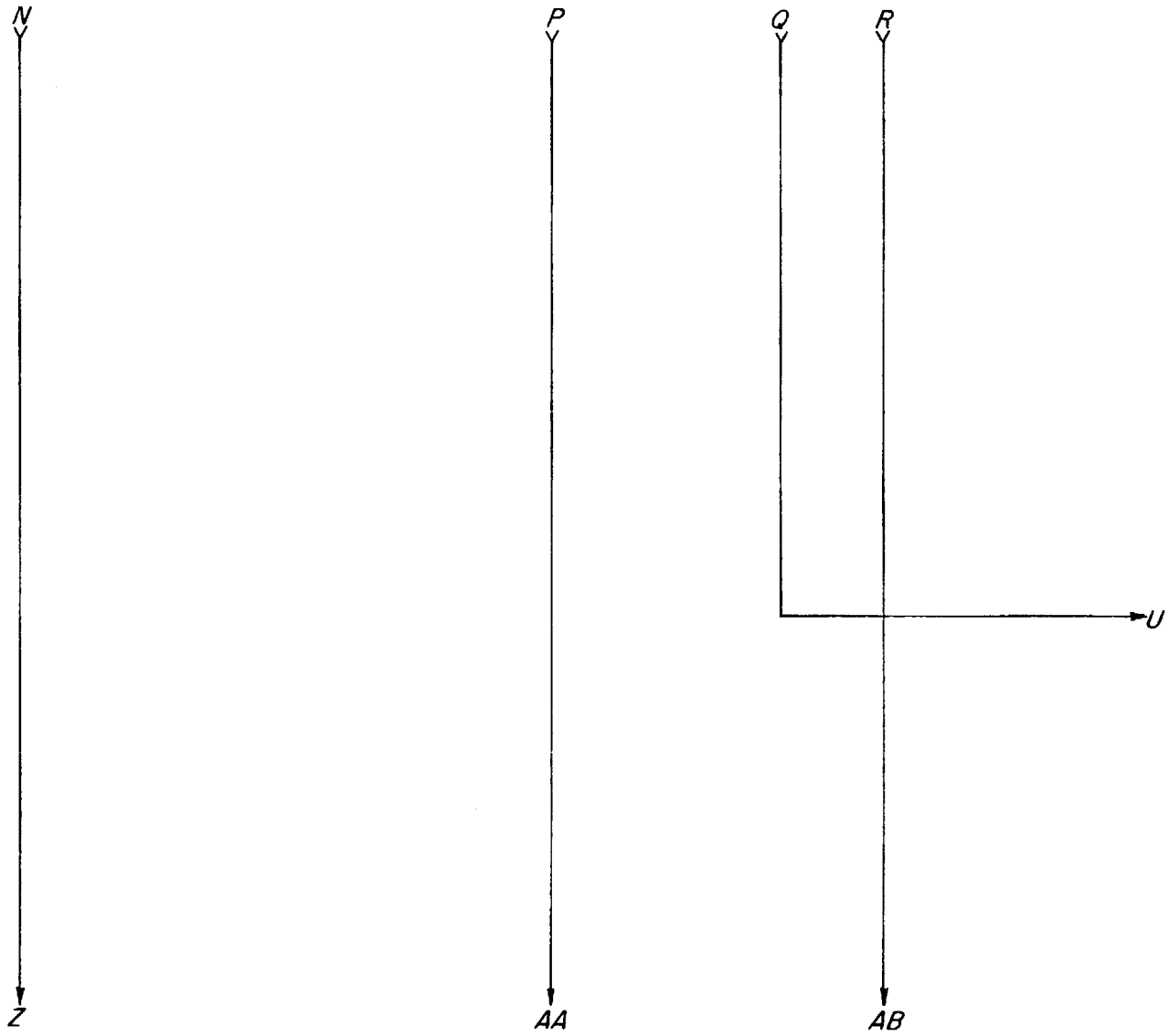
Figure 4F:
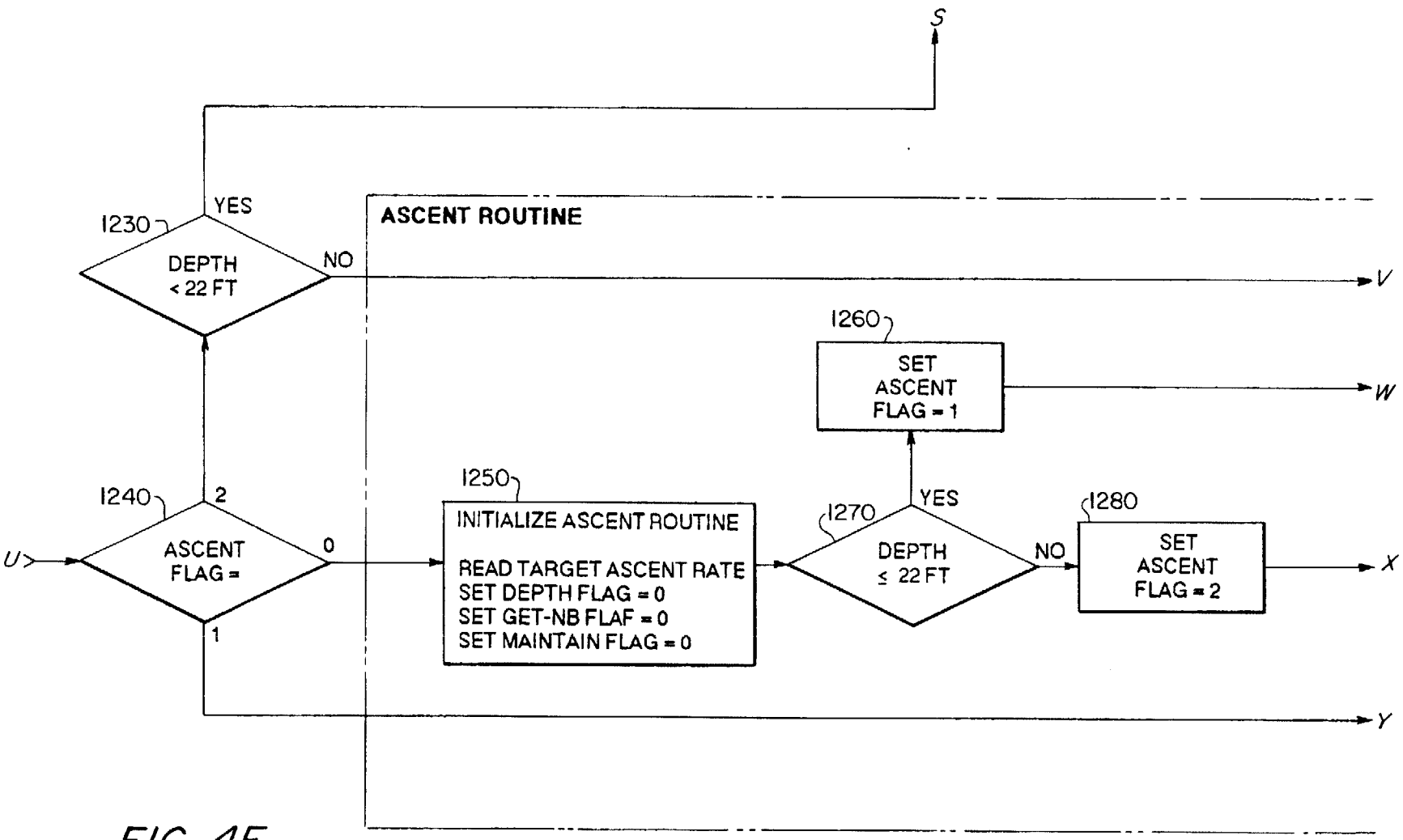
Figure 4G:
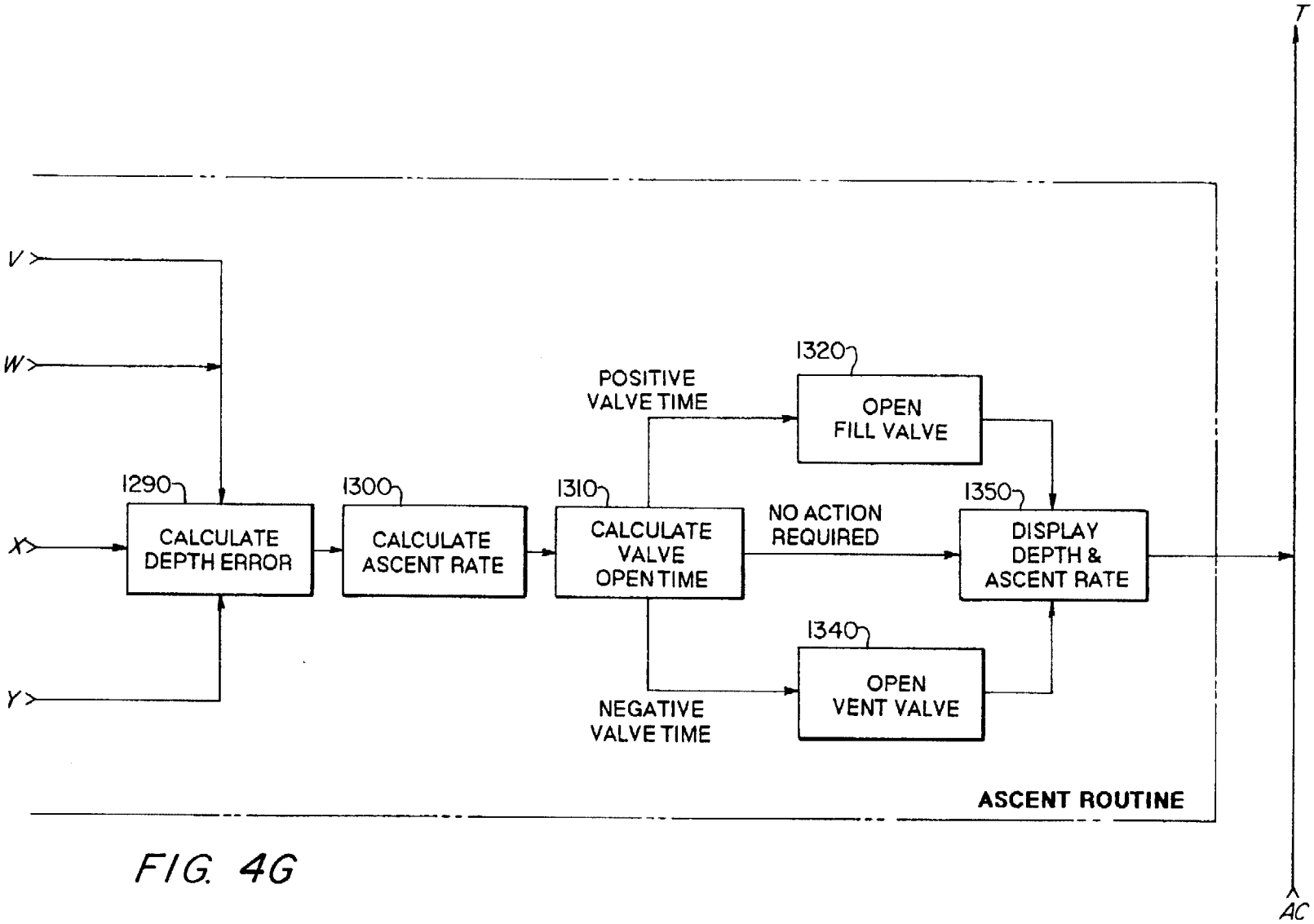
Figure 4H:
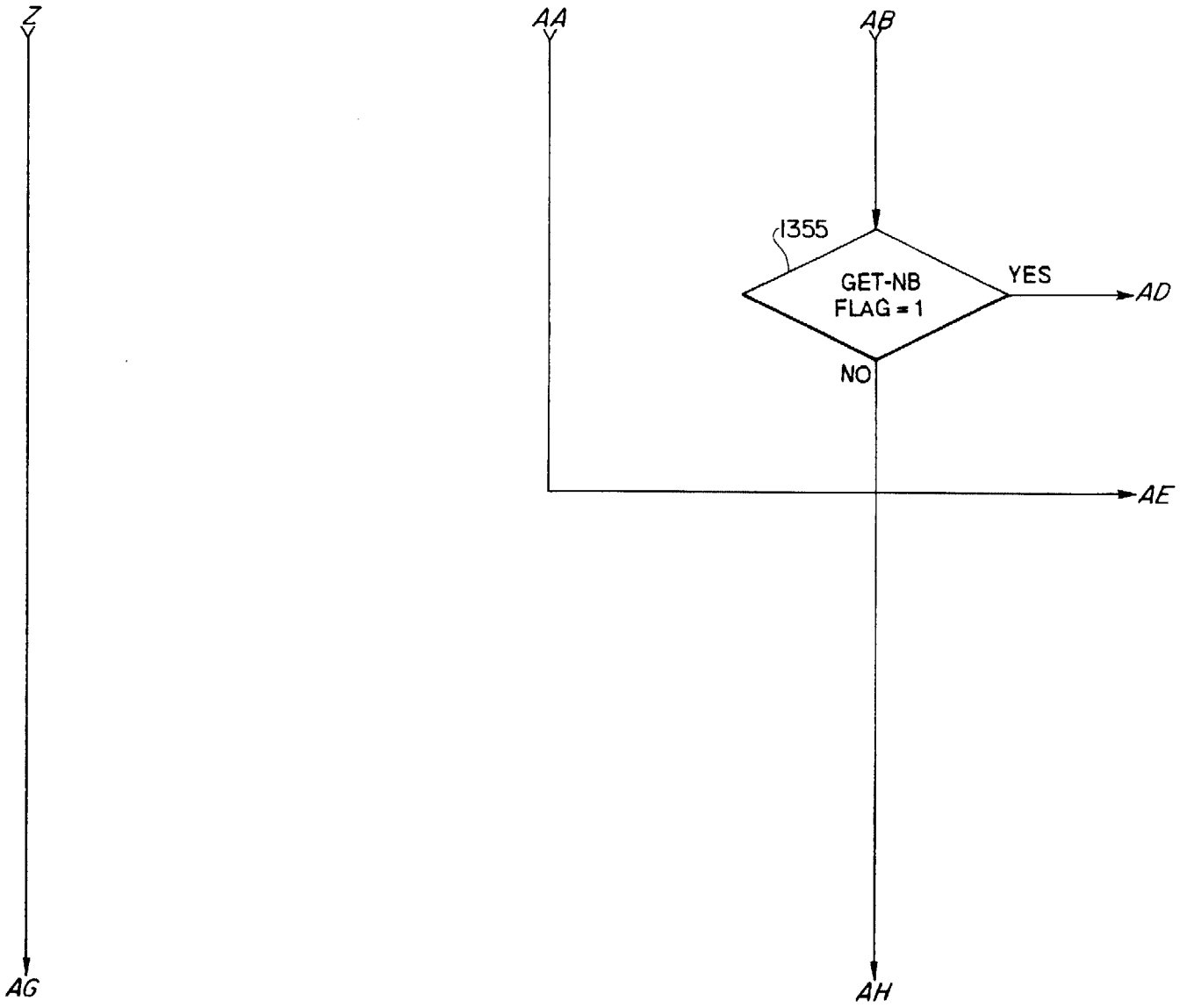
Figure 41:
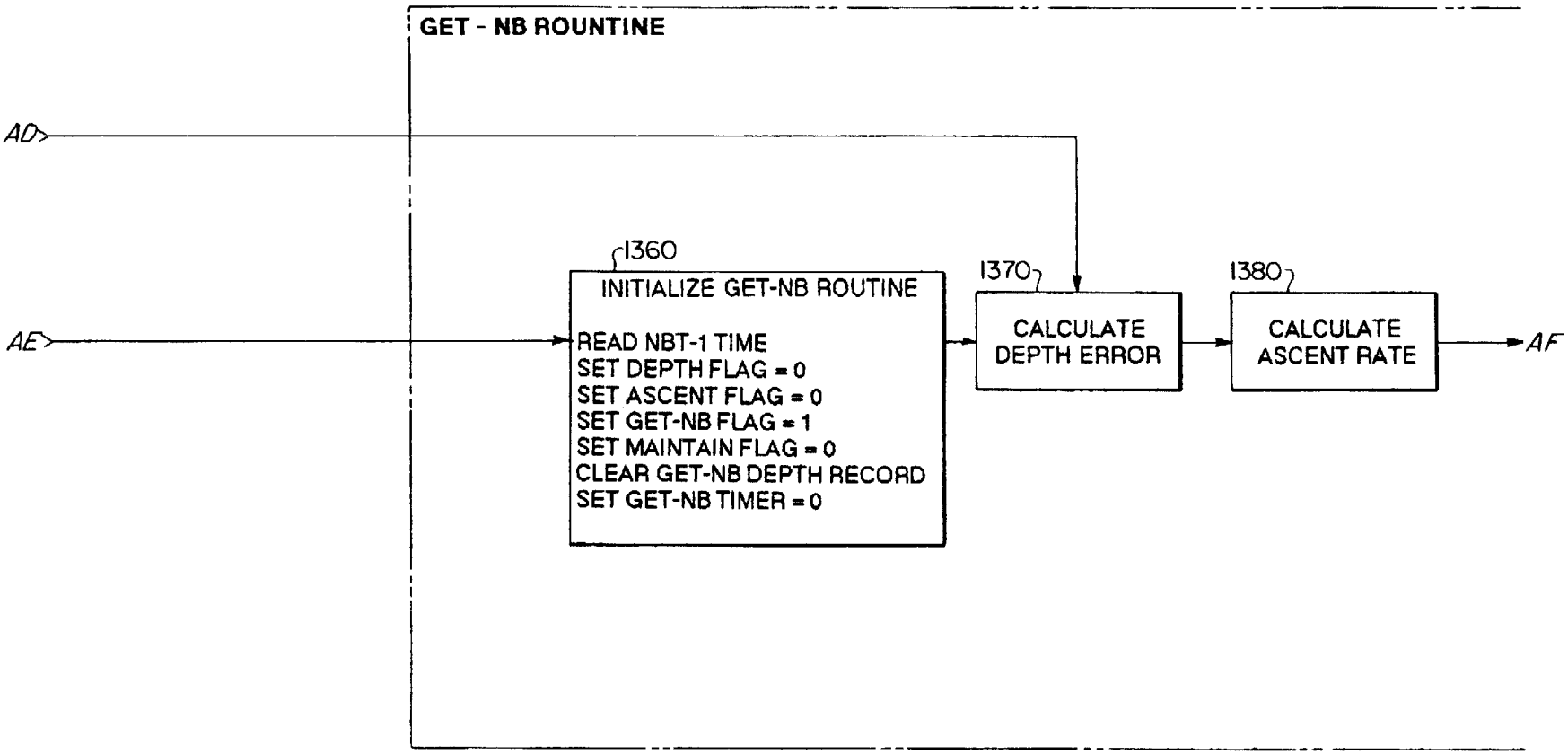
Figure 4J:
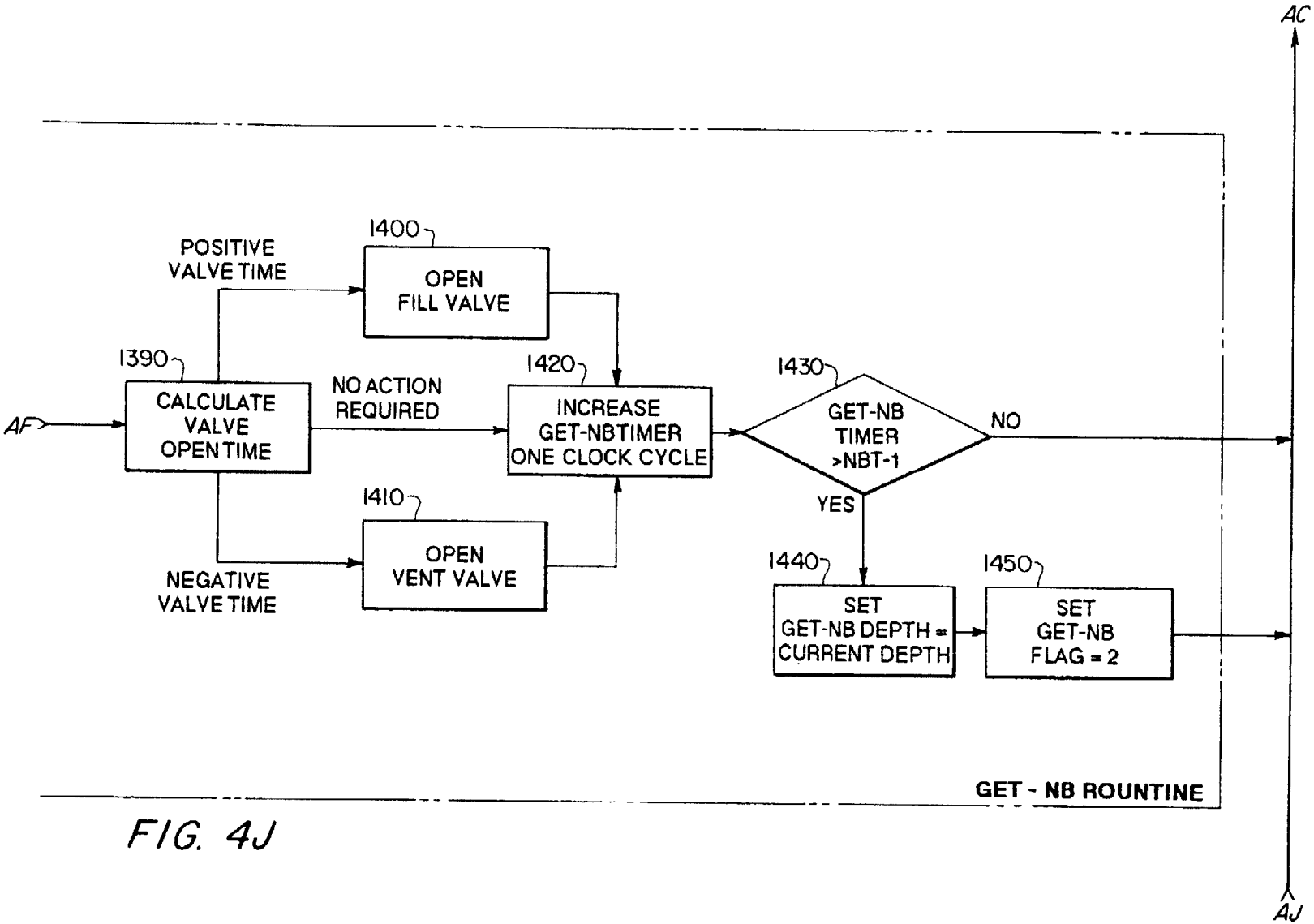
Figure 4K:
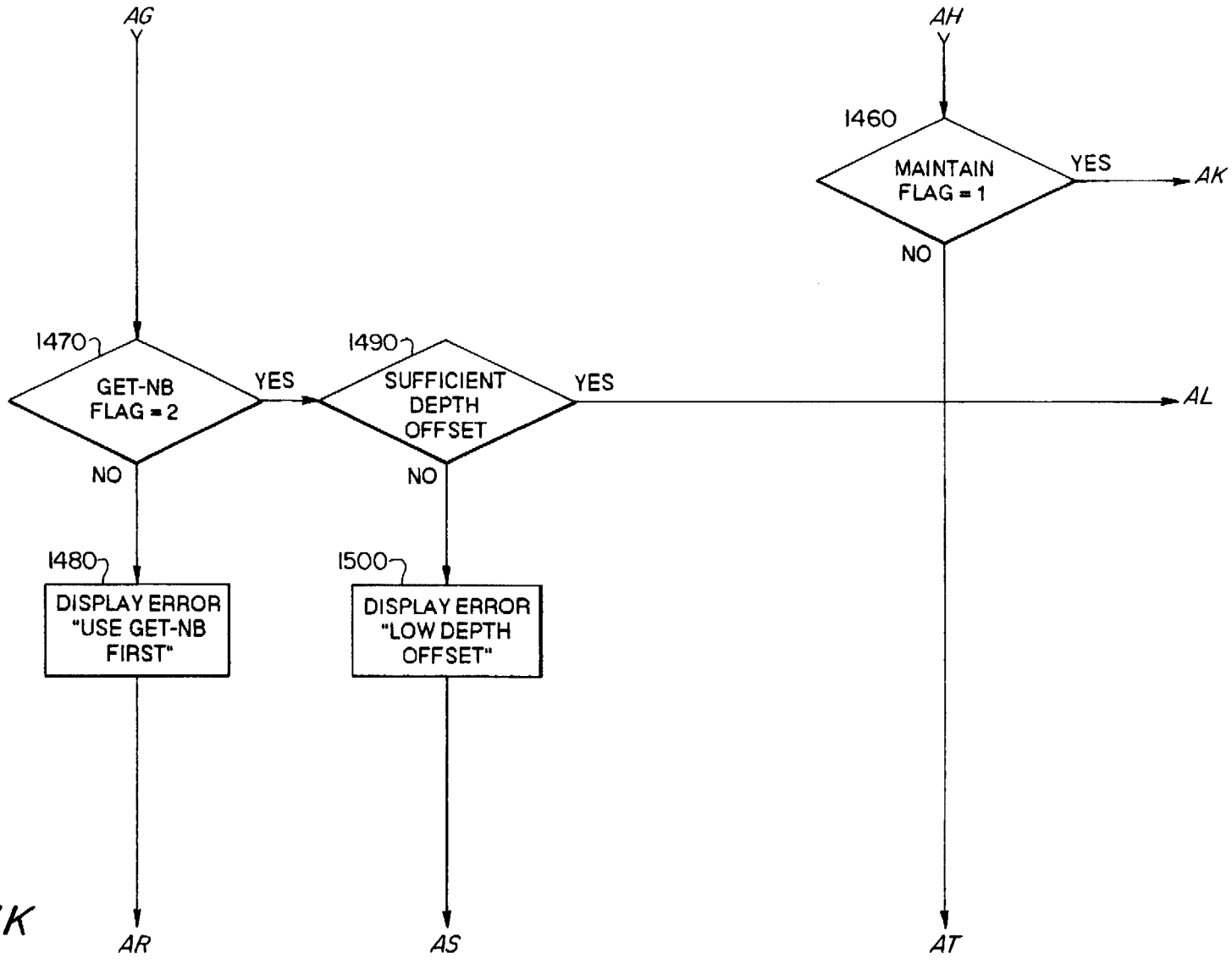
Figure 4L:
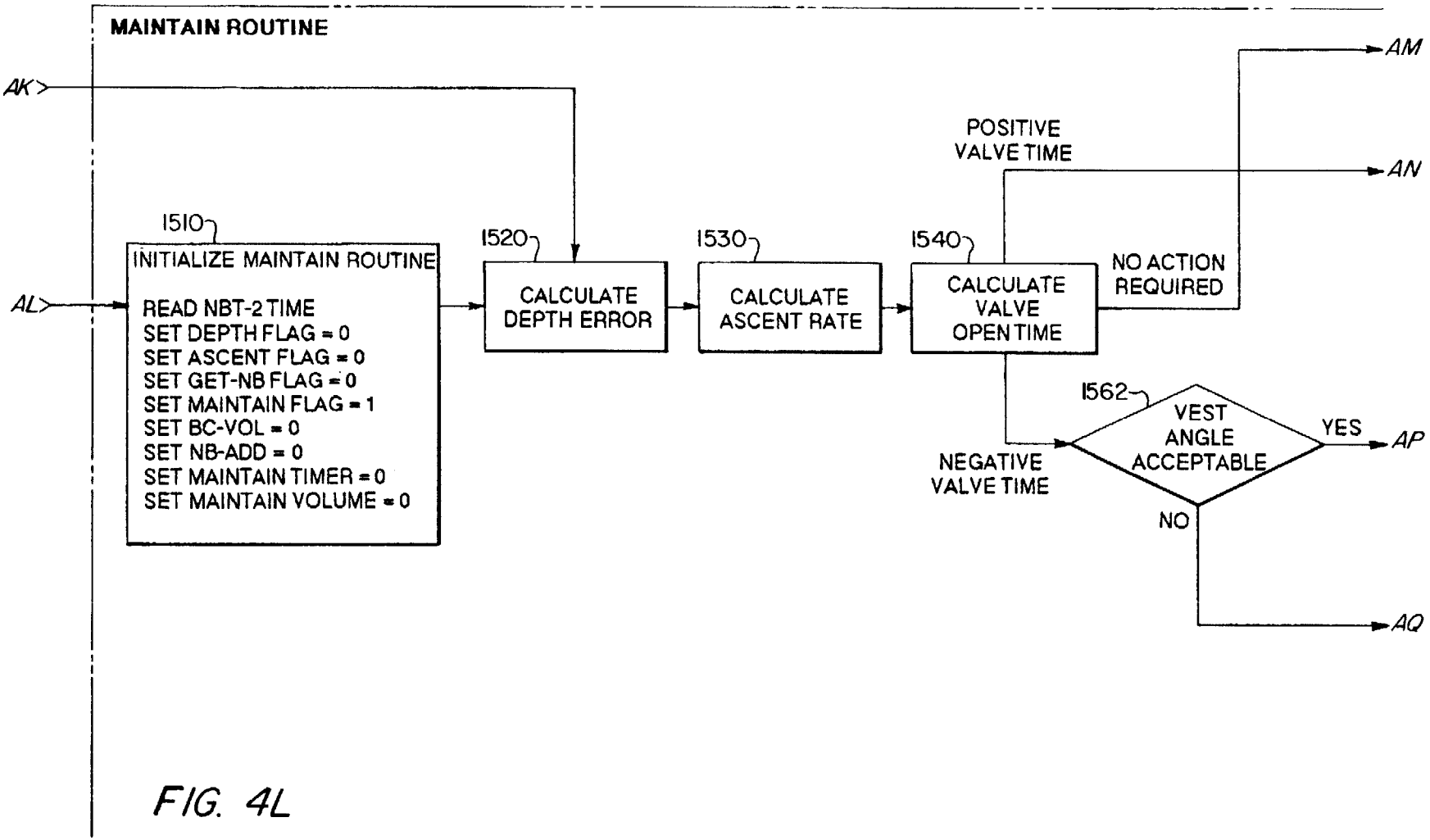
Figure 4M:
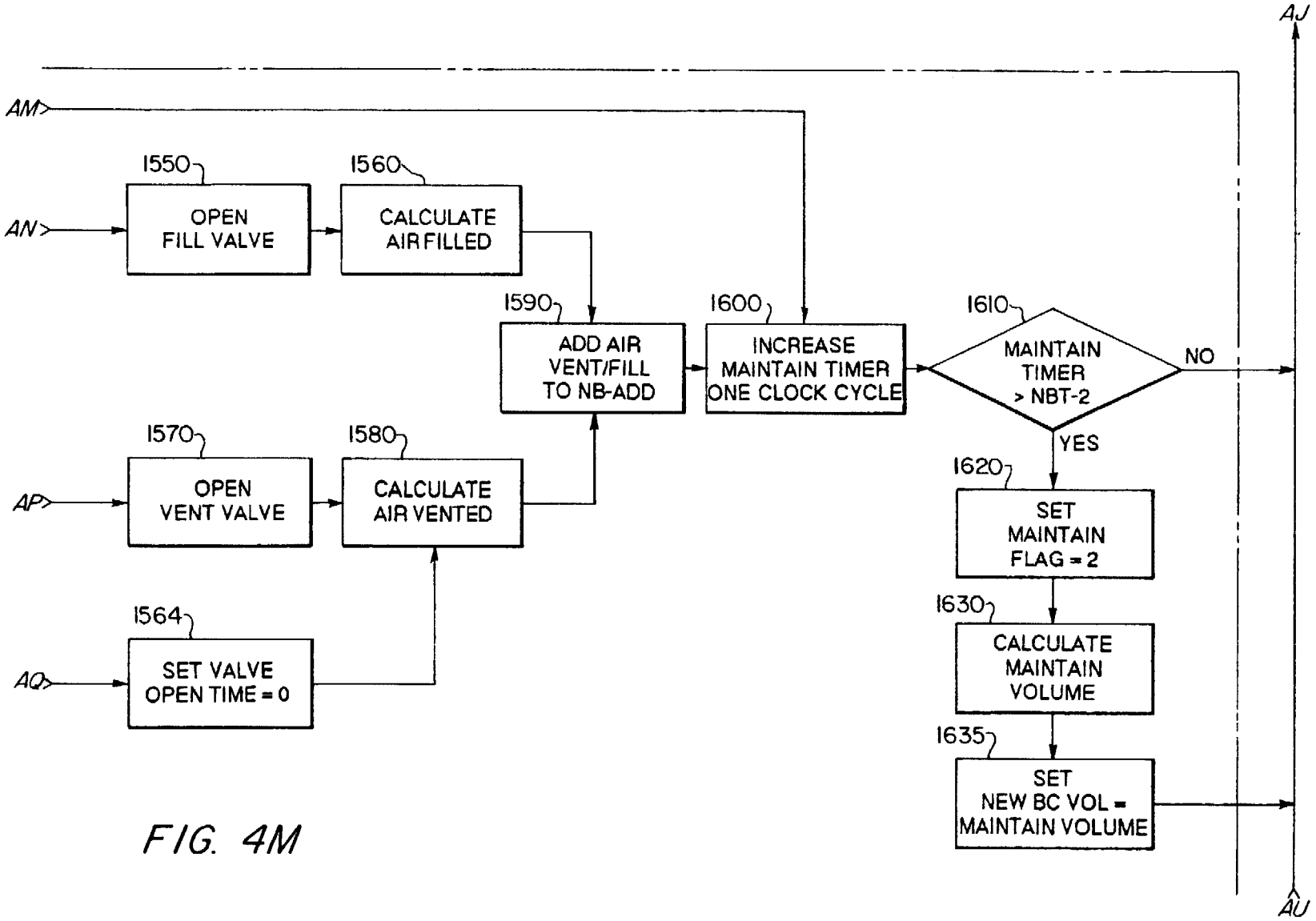
Figure 4N:
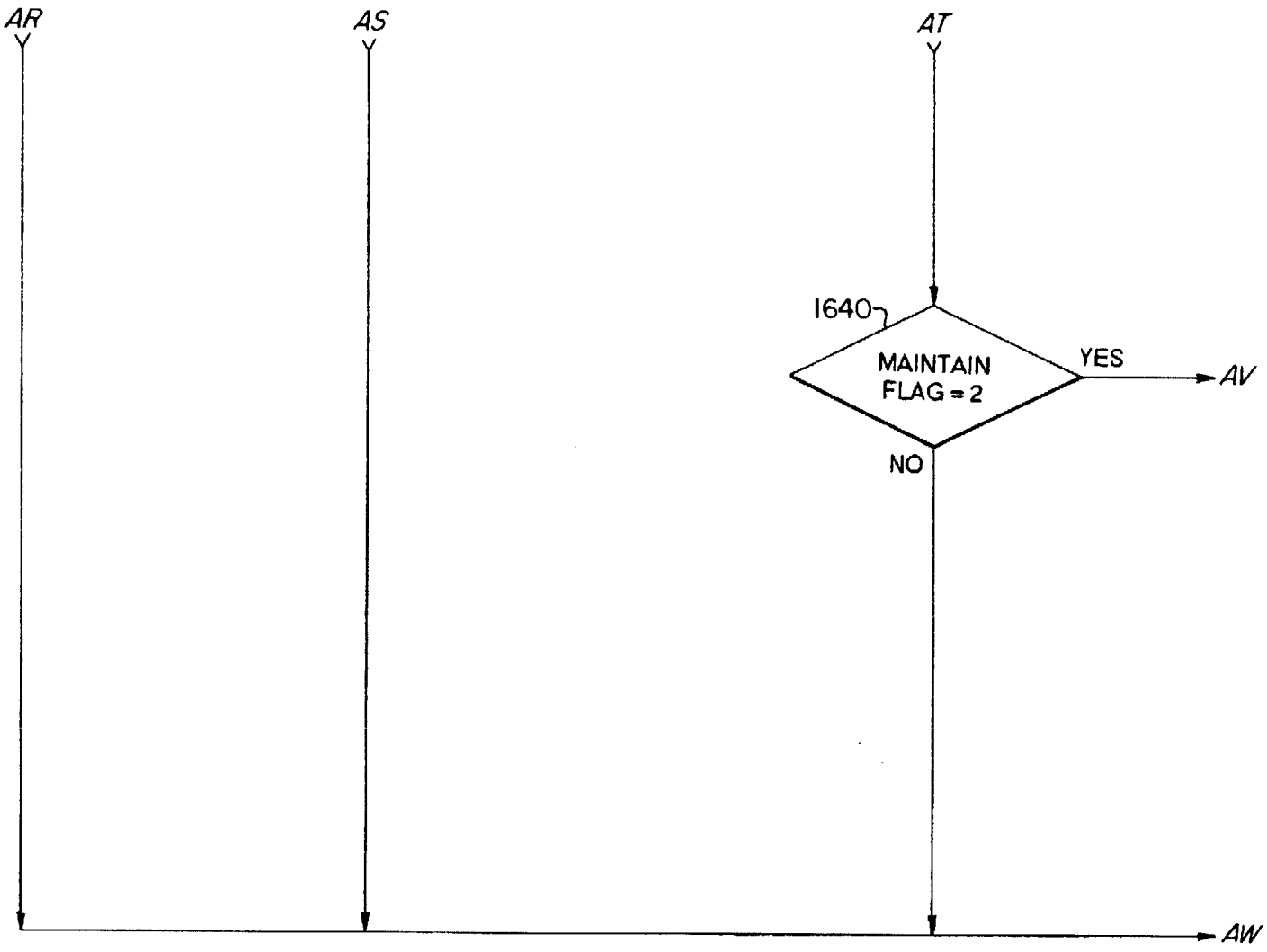
Figure 40:
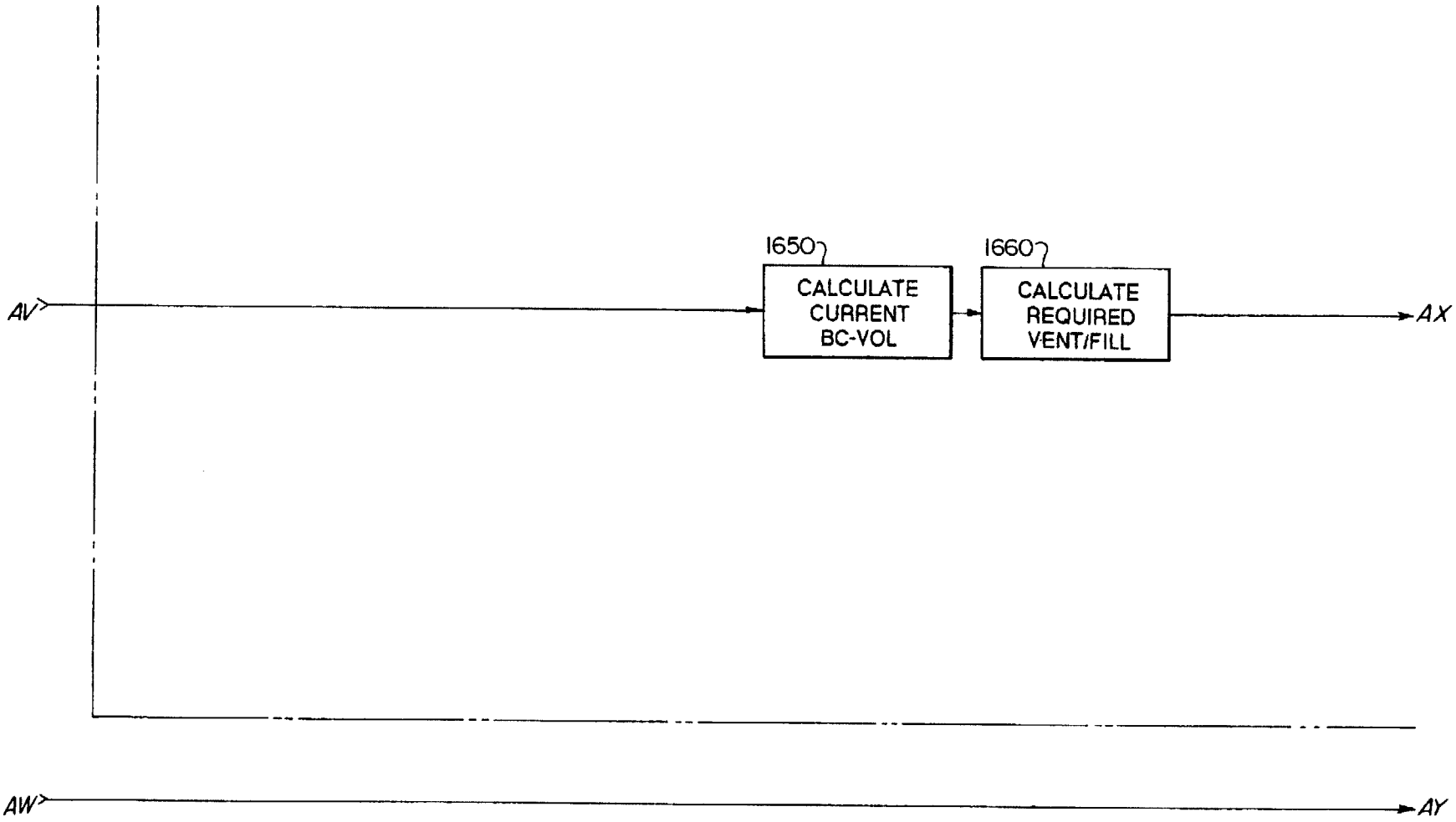
Figure 4P:
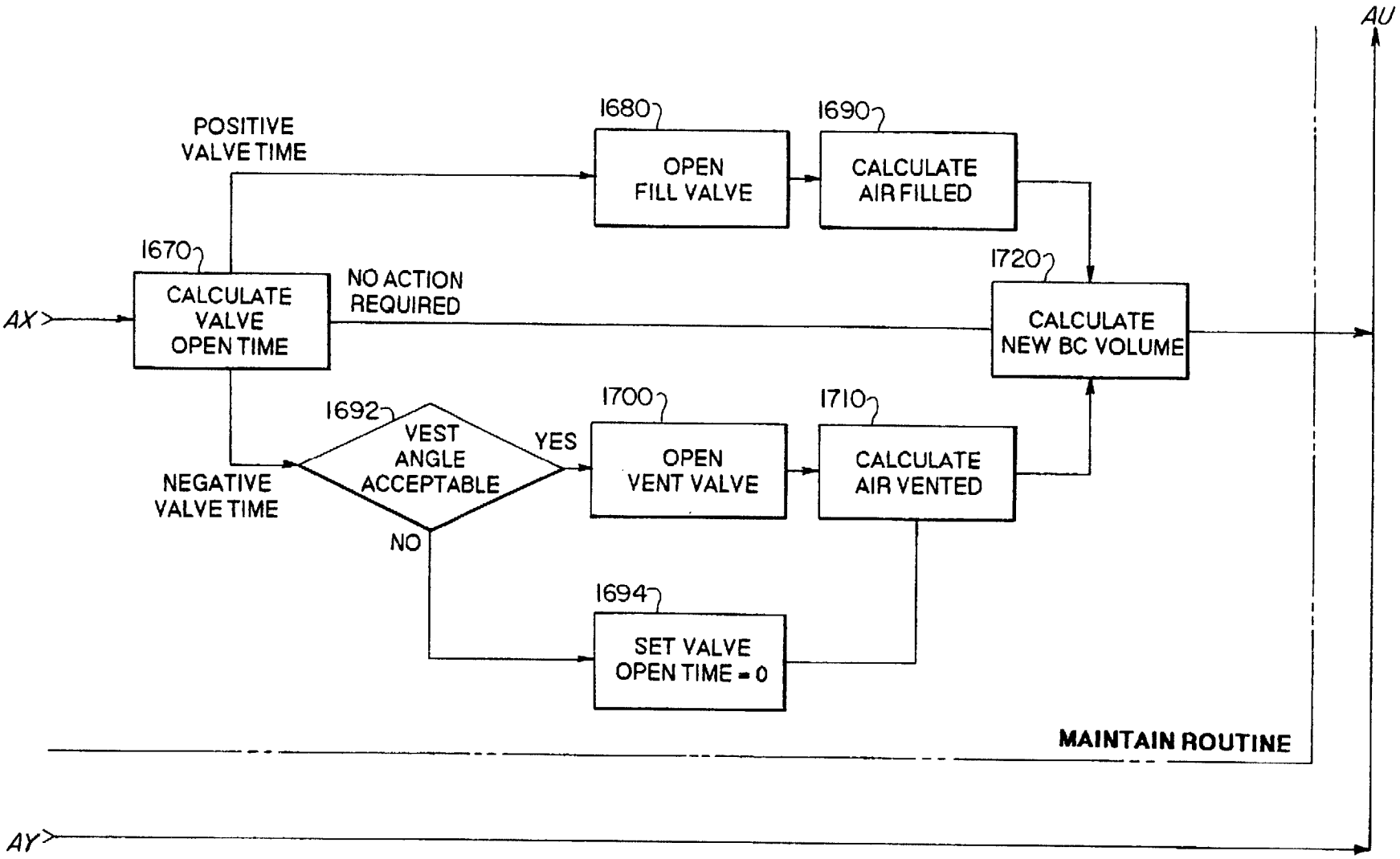

The microprocessor program which is activated when the SET NEUTRAL BUOYANCY switch 210*b* is selected, is diagrammatically shown in FIGS. 4I and 4J in the block designated GET-NB.

The GET-NB cycle begins with the microprocessing unit 104 initializing the parameters for the GET-NB Routine at step 1360, with the values shown in Table III, then in sequence calculating the depth error, the ascent rate, and the "valve open" time in steps 1370, 1380, and 1390, respectively. The "valve open" time is the amount of time one of the valves 110 and 114 is to be opened in either of steps 1400 or 1410. Someone who is knowledgeable in the art of control systems will recognize that both the change in depth as well as the rate of ascent need to be addressed when computing the amount of air necessary to provide the desired correction. For example, getting the diver to the desired depth is not sufficient; the diver may be passing through the desired depth while ascending or descending, if the rate of ascent is not also addressed.

In step 1390, if the "valve open" time is positive, the intake valve 110 is opened in step 1400 for an amount of time equal to the "valve open" time. If in step 1390 the "valve open" time is negative, the vent valve 114 is opened in step 1410 for an amount of time equal to the absolute value of the "valve open" time.

TABLE III

| Initialization of GET-NB Routine Parameters |
|---|
| Read $NBT_1$ TIME |
| Set DEPTH flag = 0 |
| Set ASCENT flag = 0 |
| Set GET-NB flag = 1 |
| Set MAINTAIN flag = 0 |
| Clear GET-NB DEPTH RECORD |
| Set GET-NB TIMER = 0 |

Following steps 1400 and 1410, processing proceeds to step 1420, in which the GET-NB timer is increased by one clock cycle. Also, if the "valve open" time in step 1390 is equal to zero, then processing proceeds directly to step 1420. The microprocessing unit 104 next examines the value of the GET-NB timer in step 1430. If the value of the GET-NB timer is less than or equal to the value of the $NBT_1$ counter, then processing returns to steps 1730 and 1740.

Assuming no other selection has been made, processing will proceed from step 1740 through step 1080 to step 1090, in which the ASCENT flag is set to zero. The microprocessing unit 104 then examines the value of the DEPTH flag parameter in step 1100. If the value of the DEPTH flag parameter is 1, then processing proceeds to the DEPTH routine, as discussed below. If the value of the DEPTH flag is not 1, then processing proceeds to step 1355, in which the microprocessing unit 104 examines the value of the GET-NB flag. If the value of the GET-NB flag equals 1, then processing returns to step 1370 of the GET-NB routine. If the value of the GET-NB flag does not equal 1, then processing proceeds to step 1460, in which the microprocessing unit 104 examines the value of the MAINTAIN flag, as will be discussed below.

If in step 1430, the value of the GET-NB TIMER counter is greater than the value of the $NBT_1$ timer, then the value of GET-NB DEPTH is set equal to the current depth in step 1440, and the value of the GET-NB flag is set equal to 2 in step 1450. Processing then returns to steps 1730 and 1740.

MAINTAIN NEUTRAL BUOYANCY ("Maintain NB Routine"): This cycle consists of two separate sub-cycles. During the first sub-cycle, the microprocessing unit 104 checks that enough offset of depth has occurred since the last GET-NB cycle. The microprocessing unit 104 then sets the diver at or near to neutral buoyancy and while performing a sequence of steps similar to those in the GET-NB cycle, it measures the amount of air being input and vented to the buoyancy chamber 22 and accumulates this total as NB-ADD. When the pre-set time period $NBT_2$ has expired, the microprocessing unit 104 computes the volume of the buoyancy chamber 22 at neutral buoyancy using the NB-ADD value. This volume at neutral buoyancy is referred to as the MAINTAIN VOLUME parameter.

For use in the second sub-cycle, the NEW BC VOLUME parameter is set equal to the MAINTAIN VOLUME parameter. When the first sub-cycle has been completed, the microprocessing unit 104 will automatically proceed to the second sub-cycle in the next clock cycle.

During the second sub-cycle, the microprocessing unit 104 maintains the volume of the buoyancy chamber 22 within an assigned range of tolerances. To do this it first determines the current volume, then calculates the difference between it and the MAINTAIN VOLUME parameter. There is a range of tolerances within the program activated by this selection, to determine when the microprocessing unit 104 corrects for the change in buoyancy chamber volume. If the change in buoyancy chamber volume is within this range, there is no correction to the buoyancy chamber volume. It is only necessary to correct the buoyancy chamber volume when the change in buoyancy chamber volume is beyond the range of tolerances. After performing the appropriate correction the microprocessing unit 104 computes the new current buoyancy chamber volume, for use during the next continuous operation of the MAINTAIN NEUTRAL BUOYANCY cycle.

The process for determining buoyancy chamber volume at neutral buoyancy consists of setting neutral buoyancy two times—once when SET NEUTRAL BUOYANCY is selected (as required before selecting the MAINTAIN NEUTRAL BUOYANCY), and again during the first sub-cycle of the MAINTAIN NEUTRAL BUOYANCY—and then computing the buoyancy chamber volume. When setting neutral buoyancy the second time, the microprocessing unit 104 measures the amount of air passing through the valves 110 and 114. Using this measured volume, present depth, previous depth where neutral buoyancy was last achieved, and the knowledge that the buoyancy chamber volumes are equal at neutral buoyancy, Boyle's Law is used to determine the buoyancy chamber volume at neutral buoyancy.

It is well-known in the art that for any depth, the volume when at neutral buoyancy is the same, that is:

$$V2+\Delta \text{ buoyancy chamber volume}=V1 \quad (1)$$

Boyle's Law states:

$$V1\times P1=V2\times P2, \text{ or} \quad (2)$$

$$V2=(P1\times V1)/P2 \quad (3)$$

Combining equations (1) and (3):

$$V1-\Delta \text{ buoyancy chamber volume}=(P1\times V1)/P2$$

$$V1=((P1\times V1)/P2)+\Delta \text{ buoyancy chamber volume}$$

$$V1-((P1\times V1)/P2)=\Delta \text{ buoyancy chamber volume}$$

$$V1(1-P1/P2)=\Delta \text{ buoyancy chamber volume}$$

$$V1=\Delta \text{ buoyancy chamber volume}/(1-P1/P2)$$

It is necessary for the diver to complete the GET-NB routine at least once before selecting MAINTAIN NEUTRAL BUOYANCY. If any other selection on the keypad is made between selecting the SET NEUTRAL BUOYANCY cycle and the MAINTAIN NEUTRAL BUOYANCY cycle, the program will not permit the MAINTAIN NEUTRAL BUOYANCY cycle to operate. If another selection is made, the initialization step of the other routines will reset the GET NEUTRAL BUOYANCY flag equal to 0. Further, between selections the diver must change depth so that the buoyancy chamber volume is significantly changed due to the pressure. The required change in depth is expected to be two feet or more.

After the microprocessing unit 104 has computed the buoyancy chamber volume, it maintains that volume by adding or venting the measured amount of air as necessary by opening intake valve 110 or vent valve 114, respectively. It is not necessary to perform continuous corrections and the range of tolerances is used to indicate when adjustment is needed. The main unit 100 will maintain this buoyancy chamber volume until another selection is made.

The microprocessor program which is activated when the MAINTAIN NEUTRAL BUOYANCY switch 210*c* is selected, is diagrammatically shown in FIGS. 4L, 4M, 4O, and 4P in the block designated MAINTAIN ROUTINE.

As explained above, the maintain neutral buoyancy cycle has two sub-cycles. The first sub-cycle begins with the microprocessing unit 104 examining the value of the GET-NB flag in step 1470. If the GET-NB flag does not equal 2, then the required neutral buoyancy cycle has not been completed, an error code number or an error message is displayed (on display 212) in step 1480 and processing returns to steps 1730 and 1740 as previously described. The error code or message would inform the diver that the GET-NB cycle needs to be selected first. An example of appropriate text for the error message would be "USE GET-NB FIRST."

If the GET-NB flag does equal 2, then the microprocessing unit 104 examines the depth offset. If the depth offset since the last completed GET-NB routine is too low, then an error message "low depth offset" is displayed (on display 212) in step 1500 and processing returns to steps 1730 and 1740. If the depth offset is adequate, then the first sub-cycle of neutral buoyancy cycle proceeds.

The first sub-cycle proceeds with initialization of the parameters for the "Get-NB" Routine at step 1510, with the values shown in Table IV, then in sequence calculating the depth error, the ascent rate, and the "valve open" time in steps 1520, 1530, and 1540, respectively. The "valve open" time is the amount of time one of the valves is to be opened in either of steps 1550 or 1570. In step 1540, if the "valve open" time is positive, the intake valve 110 is opened in step 1550 for an amount of time equal to the "valve open" time and then the volume of air admitted by the intake valve 110 into the buoyancy chamber 22 is calculated in step 1560.

If in step 1540 the "valve open" time is negative, then in step 1562, the vest angle is checked, using the tilt sensor 128, to determine if it is at an acceptable value. This minimum acceptable angle may vary by vest manufacturer and vest model, and can be determined by routine testing. It is expected to be close to the horizontal. The purpose of this step is to determine if the vest 20 is positioned so that the air inside the buoyancy chamber 22 is in contact with the first and second main passages 150 and 152. It is possible for a diver to be positioned in the water, commonly with his head below his shoulders, so that the air inside the vest 20 is away from the opening 24 where the main unit 100 is attached. When the diver is in this position, air will not vent out of the vest 20 when the vent valve 114 is opened. This condition must be taken into account later both sub-cycles of the Maintain NB Routine. Thus, in step 1562, if the vest angle is acceptable, processing proceeds to step 1570.

The vent valve 114 is opened in step 1570 for an amount of time equal to the absolute value of the "valve open" time and then the volume of air vented out of the buoyancy chamber 22 through the vent valve 114 is calculated in step 1580. If, in step 1562, the vest angle is not acceptable, processing proceeds to step 1564, in which the "valve open" time is set equal to zero, and then proceeds directly to step 1580. Processing then returns to step 1590, described below.

TABLE IV

| Initialization of GET-NB Routine Parameters |
|---|
| Read $NBT_2$ TIME |
| Set DEPTH flag = 0 |
| Set ASCENT flag = 0 |
| Set GET-NB flag = 0 |
| Set MAINTAIN flag = 1 |
| Set BC-VOL = 0 |
| Set NB-ADD = 0 |
| Set MAINTAIN TIMER = 0 |
| Set MAINTAIN VOLUME = 0 |

Following steps 1560 and 1580, the microprocessing unit 104 in step 1590 adds the volume calculated in step 1560 or step 1580, respectively, to the NB-ADD parameter (which was set to zero in initialization step 1010). The NB-ADD parameter represents the change in buoyancy chamber volume, and is used in the second sub-cycle to calculate the buoyancy chamber volume at neutral buoyancy. Processing then proceeds to step 1600, in which the MAINTAIN TIMER counter is increased by one clock cycle. If the "valve open" time in step 1540 is equal to zero, then processing proceeds directly to step 1600.

The microprocessing unit 104 next examines the value of the MAINTAIN TIMER counter in step 1610. If the value of the MAINTAIN TIMER counter is less than or equal to the value of the $NBT_2$ counter, then processing returns to steps 1730 and 1740. If the value of the MAINTAIN TIMER counter is greater than the value of the $NBT_2$ timer, then the MAINTAIN flag is set to 2 in step 1620 and processing proceeds to step 1630.

In step 1630, the microprocessing unit 104 computes the buoyancy chamber volume when at neutral buoyancy by using the NB-ADD value. This buoyancy chamber volume at neutral buoyancy is referred to as the MAINTAIN VOLUME parameter. For use in the second sub-cycle, the NEW BC VOLUME parameter is set equal to the MAINTAIN VOLUME parameter in step 1635. Step 1635 is the last step of the first sub-cycle. Processing proceeds from step 1635 back to steps 1730 and 1740. The microprocessing unit 104 will then proceed through steps 1080, 1355, and 1460 to begin the second sub-cycle in the next clock cycle, assuming that no other selection has been made by the diver.

As described above, in step 1460, the microprocessing unit 104 examines the value of the MAINTAIN flag. As shown in Table IV, the MAINTAIN flag is set to 1 at initiation of the MAINTAIN NB routine. At the end of the first sub-cycle, the MAINTAIN flag retains a value of 1, so that the first sub-cycle is repeated by returning to step 1520. During this repetition of the first sub-cycle, the unit 10 measures the volume of air being input to or vented from the buoyancy chamber 22 and adds it to the NB-ADD parameter in step 1590. The net volume of air calculated in step 1590 is then used in steps 1630 and 1635 to calculate the buoyancy chamber volume. Only after the buoyancy chamber volume has been calculated is it possible to maintain that known volume.

If the MAINTAIN flag does not equal 1, then processing proceeds to step 1640, in which the microprocessing unit 104 again examines the value of the MAINTAIN flag. If the MAINTAIN flag does not equal 2, then processing returns to steps 1730 and 1740. If the MAINTAIN flag equals 2 (having been set to equal 2 in step 1620 after repetition of the first sub-cycle), then the second sub-cycle begins with steps 1650 and 1660.

In step 1650, the microprocessing unit 104 calculates the current buoyancy chamber volume CURRENT BC-VOL resulting from the effect of change in ambient pressure by applying Boyle's Law to the previous BC Volume assigned in step 1730; and in step 1660, it uses CURRENT BC-VOL to calculate the volume of air required to be input to or vented from the buoyancy chamber 22 to maintain neutral buoyancy. The microprocessing unit 104 then examines this volume in step 1670 to determine if it is within a range of tolerances, and performs the required action in steps 1680 and 1700, causing the intake valve 110 or the vent valve 114, respectively to open. The range of tolerances for the air volume is estimated to be ±1 pound of buoyancy for a diver. It can be set in the programming to any acceptable value, depending on such factors as the mass and drag of the diver or equipment to which the module control module 10 is attached.

In step 1670, if the "valve open" time is positive, the intake valve 110 is opened in step 1680 for an amount of time equal to the "valve open" time and then the volume of air admitted by the intake valve 110 into the buoyancy chamber 22 is calculated in step 1690. If in step 1670 the "valve open" time is negative, then in step 1692, the vest angle is checked, again using the tilt sensor 128. If the vest angle is acceptable (described above), processing proceeds to step 1700. The vent valve 114 is opened in step 1700 for an amount of time equal to the absolute value of the "valve open" time and then the volume of air vented out of the buoyancy chamber 22 through the vent valve 114 is calculated in step 1710. If, in step 1692, the vest angle is not acceptable, processing proceeds to step 1694, in which the "valve open" time is set equal to zero, and then proceeds directly to step 1710. Following both of steps 1690 and 1710, processing proceeds to step 1720, in which the NEW BC VOLUME parameter is calculated. Processing then returns to steps 1730 and 1740.

MAINTAIN DEPTH: This selection causes the microprocessing unit 104 to control the diver's depth. Upon activation, the program uses the current ambient pressure reading as the reference depth. The range of tolerance from the reference depth is contained in the programming. It is expected to be about ±2 feet. The microprocessing unit 104 controls the diver's depth by adding or venting air when the diver moves outside the range. By using the change in depth that occurred from the previous clock cycle and the calculated ascent rate of the diver, the microprocessing unit 104 calculates the amount of time either the intake valve 110 or the vent valve 114 should be opened to bring the diver to the correct depth range and bring the divers ascent rate near zero.

The microprocessor program which is activated when the MAINTAIN DEPTH switch **210*d* is selected, is diagrammatically shown in FIGS. 4C and 4D in the block designated DEPTH. Depth control begins with the microprocessing unit 104 initializing the parameters for the DEPTH Routine at step 1140, with the values shown in Table V. The microprocessing unit 104 then calculates the depth error and the ascent rate in steps 1150 and 1160, respectively, and using the depth error and the ascent rate, calculates the valve open time in step 1170. The appropriate valve 110 or 114** is then opened, depending upon whether the time is positive or negative.

TABLE V

| Initialization of DEPTH Routine Parameters |
|---|
| Set TARGET DEPTH = CURRENT DEPTH |
| Set DEPTH flag = 1 |
| Set ASCENT flag = 0 |
| Set GET-NB flag = 0 |
| Set MAINTAIN flag = 0 |

Following steps 1180 and 1190, or if the valve open time is equal to zero, processing proceeds to step 2000, in which the current depth and target depth are displayed on display 212. Processing then returns to steps 1730 and 1740. If no other selection is made, then the DEPTH flag will remain set to 1, and from step 1080, processing will proceed through steps 1090 and 1100 back to step 1150 for repetition of the DEPTH routine.

The DEPTH routine can also be entered through the ASCENT routine, as will be described below. When this occurs, the microprocessing unit 104 re-initializes the parameters for the DEPTH Routine at step 1220, with the values shown in Table VI. Processing then proceeds back to step 1150, as previously described.

TABLE VI

| Initialization of DEPTH Routine Parameters Following Ascent to 22 Feet |
|---|
| Set TARGET DEPTH flag = 20 feet |
| Set DEPTH flag = 1 |
| Set ASCENT flag = 3 |

ASCEND: The ASCEND switch **210*e* must be held down to keep this selection activated. The microprocessing unit 104 will first determine if the diver is at a depth less than 22 feet. If the diver is at a depth of 22 feet or more, a safety stop is planned. If the diver is at a depth of less than 22 feet, no safety stop is planned. The microprocessing unit 104** then calculates the depth error, the ascent rate, and using these, the valve open time. The appropriate valve is then opened to maintain the ascent rate within the assigned tolerances.

It is noted that the exact depth values described herein are preferred but are not required, and thus can be changed. In step 1270, the microprocessing unit 104 will check whether, at step 1230, the diver was above or below the activation depth for the DEPTH routine in this case 22 feet. If the diver is starting deeper than the activation depth in step 1230, the microprocessing unit 104 will perform the DEPTH cycle when it reaches a depth less than the activation depth. The target depth used during this DEPTH cycle is predetermined and is the safety stop depth. The DEPTH cycle is started before actually reaching the safety stop to make the diver aware of what is happening and to allow for some change in depth while performing the safety stop.

If the diver started at a depth of less than 22 feet, the ASCENT cycle will be permitted to continue until the SHALLOW DEPTH parameter (which preferably is 5 feet), is reached. If the diver started at a depth of greater than 22 feet, he will continue to ascend until he reaches a depth of 22 feet. At this time, the microprocessing unit 104 will automatically perform the DEPTH cycle and keep the diver at 20' feet for a safety stop. This will occur even if the diver continues to hold down the ASCENT switch **210*e*. The safety stop will continue until another selection is made. The diver will be able to use the ASCENT cycle after releasing the ASCENT switch 210*e*, then pressing either the SUSPEND switch 210*a* or DEPTH switch 210*d*, then pressing the ASCENT switch 210*e*** again. The safety stop depth and activation depth are predetermined and can be changed as desired.

The microprocessor program which is activated when the ASCEND switch **210*e* is selected, is diagrammatically shown in FIGS. 4F and 4G in the block designated ASCENT. The ascent cycle begins with the microprocessing unit 104 examining the value of the ASCENT flag in step 1210. If the value of the ASCENT flag equals 3, the processing proceeds to step 1150, as previously described. If the value of the ASCENT flag is not equal to 3, then processing proceeds to step 1240, in which the microprocessing unit 104** again examines the value of ASCENT flag.

If in step 1240, the value of the ASCENT flag equals 0, then processing proceeds with the initialization of the parameters for the ASCENT Routine at step 1250, with the values shown in Table VII. Processing proceeds to step 1270, in which the microprocessing unit 104 examines the depth. If the depth is less than or equal to 22 feet, then in step 1280, the ASCENT flag is set to 2 and processing proceeds to step 1290. If the depth is greater than 22 feet, then the ASCENT flag is set to 1 and processing proceeds to step 1290.

TABLE VII

| Initialization of ASCENT Routine Parameters |
|---|
| Read TARGET ASCENT RATE |
| Set DEPTH flag = 0 |
| Set GET-NB flag = 0 |
| Set MAINTAIN flag = 0 |

The microprocessing unit 104 calculates the depth error and the ascent rate in steps 1290 and 1300, respectively, and using the depth error and the ascent rate, calculates the valve open time in step 1310. The appropriate valve 110 or 114 is then opened in step 1320 or 1340, depending upon whether the time is positive or negative, respectively. Following steps 1320 and 1340, or if the valve open time is equal to zero, processing proceeds to step 1350, in which the current depth and ascent rate are displayed on display 212 Processing then returns to steps 1730 and 1740. As previously described, the ASCEND switch **210*e* must be held down to keep this selection activated. If the ASCEND switch 210*e* remains held down, then processing returns to step 1210. If the ASCEND switch 210*e* is not still held down, then processing will proceed through steps 1090, 1100, 1355, 1460, 1640, and back again to steps 1730 and 1740** until another selection is made.

If in step 1240, the ASCENT flag has a value of 1, then processing proceeds directly to step 1290, as previously described. However, if the ASCENT flag has a value of 2, processing proceeds to step 1230. In step 1230, the microprocessing unit 104 examines the depth. If the depth is less than 22 feet, then processing proceeds to step 1220, as previously described. If the depth is not less than 22 feet, the processing proceeds directly to step 1290, again as previously described.

The tone generator 126 is used to notify the diver when important actions are occurring. Examples include, but are not limited to, notification that: the SET NEUTRAL BUOYANCY cycle has been completed, the MAINTAIN DEPTH selection is in effect, the safety stop depth is being neared during the ASCEND mode, the module 10 is unable to start the MAINTAIN NEUTRAL BUOYANCY cycle, or any other actions or milestones in the programming are occurring, of which the diver would benefit from being aware.

As mentioned above, the intake and vent valves 110 and 114 will be in the closed position when not activated during one of the routines indicated by the selection of one of switches 210*b*–210*e*. To control buoyancy, it is necessary for the microprocessing unit 104 to be able to control the volume of air being input to and vented from the vest 20 quickly and accurately. The valves 110 and 114 thus need to be of sufficient volume capacity and reaction speed to be able to accomplish this. The greater the buoyancy volume to be controlled the greater the valve volume needs to be. The speed of the valves 110 and 114 needs to be fast enough to accurately control the volume in small enough increments. This required speed will vary depending on the range of tolerances acceptable in the programming. The microprocessing unit 104 will apply a model of the valve to determine the correct time period necessary to input or release a known volume of air. This model will result from actual testing of the valve under static conditions. Valves with the necessary combinations of these factors are commercially available to those knowledgeable in the industry.

The vent valve 114 must be able to handle, while ascending, the maximum buoyancy chamber volume to be controlled. This means the valve 114 must be able to vent a greater volume of air then the increase in buoyancy chamber volume per clock cycle, resulting from the reduction in ambient pressure while ascending. Therefore the required maximum capacity of the valve 114 is determined by the maximum volume of the buoyancy chamber to be controlled, the maximum potential rate of ascent, and the minimum depth at which the volume control module 10 is designed to operate. If the valve 114 is of insufficient capacity it would be possible for an uncontrollable ascent to occur.

As the vest 20 ascends, the volume will expand according to Boyle's Law:

$$P1 \times V1 = P2 \times V2,$$

where P1 is the absolute pressure at starting depth, V1 is the buoyancy chamber volume at starting pressure, P2 is the absolute pressure at new depth (resulting from ascent), and V2 is the new buoyancy chamber volume at the new depth. When ascending, V2 will be greater than V1. The difference is the increase in buoyancy chamber volume due to pressure changes. The vent valve 114 must be able to vent the difference in buoyancy chamber volume plus the amount computed by the microprocessing unit 104 needed to perform the selected action, to be able to control the maximum buoyancy chamber volume.

The minimum volume the vent valve 114 needs to be able to control during one clock cycle has to be less than the volume determined by the minimum range of tolerance for any of the selector pad options. For example, if the minimum range is plus or minus one pound of buoyancy, then the minimum volume of the vent valve 114 must be less than two pounds of buoyancy. If the minimum vent volume is not less then this, the microprocessing unit 104 will not be able to control the buoyancy chamber volume within the required range.

An example of the method used to determine the required vent valve minimum and maximum values and their computation is as follows. Maximum buoyancy chamber volume equals 0.546875 cubic feet (35 pounds buoyancy). Maximum rate of ascent equals 120 feet per minute. Minimum range of tolerance equals ±1 pound buoyancy. The minimum operational depth equals 20 feet. The clock cycle equals one-tenth of a second. The greatest expansion of the maximum buoyancy chamber volume will occur between 21 feet to 20 feet. At the maximum rate of ascent it will take 0.5 second to travel one foot. The distance traveled in one clock cycle is 0.2 foot. During each clock cycle, the buoyancy chamber volume will expand according to Boyle's law. The maximum buoyancy chamber volume will expand an additional 0.0020623 cubic foot during the last 0.02 foot. The vent valve 114 will need to control this additional volume and the amount required by the programming. With a maximum buoyancy chamber volume of 35 pounds buoyancy and the diver being 2 pounds negative initially, the excess buoyancy is 33 pounds of buoyancy, which equals 0.515625 cubic foot. The maximum volume to be controlled as required by the program is determined by dividing this volume by the number of clock cycles allowed in the SET NEUTRAL BUOYANCY program. By adding the two volumes, the total maximum valve volume is computed.

The minimum range of ±1 pound of buoyancy equates to 0.03125 cubic foot. By controlling the length of time the valve 114 is open, the amount of buoyancy chamber volume vented can be accurately controlled. The minimum response timing of the valve 114 will determine the minimum volume the valve 114 can release. The faster the response time, the smaller the volume. Therefore, the response time of the vent valve 114 will have to be fast enough to limit the valve volume to 0.03125 cubic foot or less per clock cycle.

The maximum intake valve volume is related to the volume change when descending with the maximum buoyancy chamber volume to be controlled. Boyle's Law will effect the buoyancy chamber volume as indicated above, and the difference between V1 and V2 will represent the reduction of buoyancy chamber volume due to pressure changes. The intake valve 110 must be able to input this difference in volume plus any amount instructed by the microprocessing unit 104. The same calculations presented for the vent valve 114 will apply to determining the requirements of the intake valve 110.

The minimum intake valve volume is computed the same as the minimum vent valve volume.

In situations where a single valve cannot meet the maximum and minimum volume requirements, it may be necessary to use more than one valve. Anyone knowledgeable in the art of valves should be able to select valves to meet the above descriptions.

The capabilities of the volume control module 10 and its main unit 100 unit are not limited to the selections described above. Additional selections can easily be added to the main unit 100 by using the above-described programming or modifying for use in other applications. Some examples are:

(1) Limiting maximum depth. This application would be beneficial to inexperienced divers and divers using other air mixtures; and could be accomplished by using the MAINTAIN DEPTH program, setting the upper end of the range of tolerances equal to zero, and the lower range equal to the maximum depth. For this application, the MAINTAIN DEPTH program would applied automatically at the beginning of every clock cycle.

(2) Inclusion of decompression stops. For this application, the ASCENT selection could interact with a dive computer to include decompression stops as instructed. The ASCENT program would then control the diver's ascent, stopping the diver at the correct depth, for the correct time period of the decompression stop.

(3) Control of a lift bag. For this application, the ASCENT program could be modified to provide ascent a predetermined distance (for example 5 feet) and then perform the GET-NB cycle. This would be useful when freeing a mass underwater but avoiding a out of control ascent when the object is freed. The ASCEND option could then provide a safe rate of ascent. The MAINTAIN NEUTRAL BUOYANCY program would be useful while moving the lift bag and object through the water.

(4) Control of an instrument package. For this application, the main unit 100 could be attached to an instrument package to control its depth as necessary, using the selector pad 200.

(5) Directional control of a vehicle. This application could be accomplished by varying between positive and negative buoyancy and directing the motion with control surfaces such as fins, planes, rudders, or the like used to direct the flow of water past the vehicle as it ascends or descends through the water.

As indicated above, the volume control module 10 in accordance with the present invention can also be used in connection with remotely operated underwater vehicles and other equipment. Such vehicles and equipment typically have a somewhat different buoyancy control system than conventional buoyancy compensator vests. Specifically, the buoyancy control system has a pressure resistant tank containing oil. To adjust buoyancy, the oil is pumped back and forth as needed to and from a bladder. As the bladder changes size, it displaces water, thereby changing the buoyancy. The volume control module 10 in accordance with the present invention can be used to control a pump that would move oil from the storage tank into and out of the bladder in much the same way it is used to regulate the volume of air being vented into and exhausted from the buoyancy chamber of a buoyancy compensator vest as described above.

Because oil is incompressible, it is not affected by Boyle's law, which forms the basis for the computations used in the MAINTAIN cycle as described above. The MAINTAIN cycle thus would have to be revised to take into account the properties of oil, in a manner which will be known to those of skill in the art. However, the module 10 will operate properly with oil when performing the GET-NB, DEPTH, and ASCENT cycles, because these cycles are dependent on ambient pressure changes to operate.

Modifications and variations of the above-described embodiments of the present invention are possible, as appreciated by those skilled in the art in light of the above teachings. For example, valves 110 and 114 could be pilot, air operated valves, rather than solenoid operated valves. In this case, both could be controlled from a singular, three-way solenoid valve operating on the same low pressure air source as that supplied to the intake valve. Controlling the larger intake and vent valves 110 and 114 in this manner could result in a lower overall power requirement and thus a smaller battery would be necessary.

Also, the main unit 100 could be designed as part of the buoyancy vest 20. This modification would eliminate the need for the threaded fittings attach the main unit 100 to the vest 20 and the inflator hose assembly 30.

Further, it is possible for the intake valve 110 to be located in the first main internal passage 150 or even a separate third main internal passage. None of these locations would effect the operation of the volume control module 10 and the intake valve 110 would be in fluid communication with the second main passage 152.

Still further, known wireless technology can be used to replace the cable 300 between the selector pad 200 and the main unit 100 for transmitting signals therebetween. In that case, it would be necessary to provide the selector pad 200 with its own power source. It would also be possible to locate the external pressure sensor 120 separate from the main unit 100, if need be using known wireless technology to transmit the signal from the sensor 120 to the main unit 100.

It is therefore to be understood that, within the scope of the appended claims and their equivalents, the invention may be practiced otherwise than as specifically described.

What is claimed is:

1. A volume control module for controlling the volume of fluid in a buoyancy chamber of a buoyancy compensator device, comprising:

a main unit housing having a first opening connectable to a buoyancy compensator device and a second opening connectable to an inflator hose assembly;

pressure sensing means for measuring ambient pressure externally of said volume control module and generating output signals indicative of the measured ambient pressure;

a microprocessing unit encased in said main unit housing, said microprocessing unit being programmed to carry out a variety of buoyancy-control functions and being responsive to said output signals of said pressure sensing means;

an intake valve in said main unit housing, said intake valve being configured for connection to a source of low pressure fluid and being controlled by said microprocessing unit;

a vent valve in said main unit housing for venting fluid from the buoyancy chamber, said vent valve being controlled by said microprocessing unit;

a first main passage in said main unit housing extending between said first opening connectable to the buoyancy compensator device and said second opening connectable to the inflator hose assembly, said first main passage being unobstructed;

a second main passage in said main unit housing extending between said vent valve and said first opening connectable to the buoyancy compensator device, said second main passage being in fluid communication with said intake valve; and switch means for selecting one of the functions to be carried out by said microprocessing unit.

2. The volume control module of claim 1, further comprising an intake passageway in said main unit housing fluid connecting said intake valve with said second main passage.

3. The volume control module of claim 1, further comprising a first connector at said first opening, said first connector being compatible with a connector on the buoyancy compensator device and a second connector at said second opening, said second connector being compatible with a connector on the inflator hose assembly.

4. The volume control module of claim 1, further comprising a power source electrically connected to said microprocessing unit, said intake and vent valves, and said pressure sensing means.

5. The volume control module of claim 4, wherein said power source is encased in said main unit housing.

6. The volume control module of claim 1, further comprising a tone generator responsive to output signals from said microprocessing unit for generating audible messages relating to the functions being performed by said microprocessing unit.

7. The volume control module of claim 1, wherein said intake and vent valves are both changeable between open and closed conditions, said intake and vent valves are both normally in said closed condition, and said intake and vent valves are selectively openable based on the function being performed by said microprocessing unit.

8. The volume control module of claim 1, further comprising a manual emergency cutoff switch positioned on the exterior of said main unit housing in an easily accessible location to enable manual deactivation of said microprocessing unit and said intake and vent valves.

9. The volume control module of claim 1, further comprising a selector pad housing, said switch means being encased in said selector pad housing, and an electrical cable extending from said selector pad housing to said main unit housing and electrically connecting said switch means to said microprocessing unit.

10. The volume control module of claim 1, wherein said switch means comprises a plurality of switches, each of said switches corresponding to one of the buoyancy-control functions of said microprocessing unit.

11. The volume control module of claim 1, wherein said pressure sensing means also functions to measure the pressure inside said main unit housing and generate output signals indicative of the measured main unit housing pressure.

12. The volume control module of claim 11, wherein said pressure sensing means also functions to measure the pressure of the fluid input through said intake valve and generate output signals indicative of the measured input fluid pressure.

13. The volume control module of claim 12, wherein said pressure sensing means comprises separate first, second, and third pressure sensing means, said first pressure sensing means measuring the pressure of the air input through said intake valve and generating output signals indicative of the measured input air pressure, said second pressure sensing means measuring ambient pressure externally of said volume control module and generating output signals indicative of the measured ambient pressure, and said third pressure sensing means measuring the pressure inside said main unit housing and generating output signals indicative of the measured main unit housing pressure.

14. The volume control module of claim 13, wherein said first, second, and third pressure sensing means are pressure transducers.

15. The volume control module of claim 13, wherein said microprocessing unit includes means for calculating the buoyancy chamber volume necessary to achieve neutral buoyancy after moving from a starting depth to a new depth, based on the equation:

$$V1=(\text{change in buoyancy chamber volume})/(1-P1/P2),$$

where: V1 is the buoyancy chamber volume necessary to achieve neutral buoyancy,

P1 is the absolute pressure at the starting depth as measured by said second pressure sensing means, and P2 is the absolute pressure at the new depth; and wherein said microprocessing unit performs the function of measuring the change in buoyancy chamber volume while controlling said intake and vent valves during the process of setting neutral buoyancy.

16. The volume control module of claim 12, wherein said microprocessing unit includes means for computing the volume of fluid passing through said intake and vent valves based on known variables.

17. The volume control module of claim 1, further comprising sensing means for indicating when fluid in the buoyancy chamber is away from said first opening.

18. The volume control module of claim 1, further comprising sensing means for indicating when the buoyancy compensator device is at an angle when fluid in the buoyancy chamber is away from said first opening.

19. The volume control module of claim 1, further comprising volume measuring means for measuring the volume of fluid passing through said intake and vent valves and generating output signals indicative of the measured fluid volumes, wherein said microprocessing unit also is programmed to control operation of said intake and vent valves in response to the output signals received from said volume measuring means.

20. A volume control module for controlling the volume of fluid in a buoyancy chamber of a buoyancy compensator device, comprising:

a main unit housing having a first opening connectable to a buoyancy compensator device and a second opening connectable to a hose assembly;

switch means for selecting one of a plurality of buoyancy-control functions to be carried out by said volume control module;

an intake valve in said main unit housing, said intake valve being configured for connection to a source of low pressure fluid;

a vent valve in said main unit housing for venting fluid from the buoyancy chamber;

pressure sensing means for measuring ambient pressure externally of said volume control module and generating output signals indicative of the measured ambient pressure;

control means encased in said main unit housing for selectively controlling operation of said intake and vent valves in response to operation of said switch means and the output signals received from said pressure sensing means; and a primary passage in said main unit housing extending between said vent valve and said first opening connectable to the buoyancy compensator device, said primary passage being fluidly connected to said intake valve.

21. The volume control module of claim 20, wherein said control means comprises a microprocessing unit.

22. The volume control module of claim 20, further comprising a secondary passage in said main unit housing extending between said first opening connectable to the buoyancy compensator device and said second opening connectable to the hose assembly, said first main passage being unobstructed.

23. The volume control module of claim 20, further comprising an intake passageway in said main unit housing fluidly connecting said intake valve with said primary passage.

24. The volume control module of claim 20, further comprising a first connector at said first opening, said first connector being compatible with a connector on the buoyancy compensator device and a second connector at said second opening, said second connector being compatible with a connector on the inflator hose assembly.

25. The volume control module of claim 20, further comprising a power source, electrically connected to said control means, said intake and vent valves, and said pressure sensing means.

26. The volume control module of claim 25, wherein said power source is encased in said main unit housing.

27. The volume control module of claim 25, further comprising a manual emergency cutoff switch positioned on the exterior of said main unit housing and actuable to disconnect said control means and said intake and vent valves from said power source.

28. The volume control module of claim 20, further comprising a tone generator responsive to output signals from said control means for generating audible messages relating to the functions being performed by said volume control module.

29. The volume control module of claim 20, wherein said intake and vent valves are both switchable between open and closed conditions, said intake and vent valves are both normally in said closed condition, and said intake and vent valves are selectively openable by said control means based on the function being performed by said control means.

30. The volume control module of claim 20, further comprising a manual emergency cutoff switch positioned on the exterior of said main unit housing in an easily accessible location to enable manual deactivation of said control means and said intake and vent valves.

31. The volume control module of claim 20, further comprising a selector pad housing, said switch means being encased in said selector pad housing, and transmitter means for transmitting signals generated by said switch means to said control means.

32. The volume control module of claim 31, wherein said transmitter means comprises an electrical cable extending from said selector pad housing to said main unit housing and electrically connecting said switch means to said control means.

33. The volume control module of claim 20, wherein said switch means comprises a plurality of switches, each of said switches corresponding to one of the buoyancy-control functions of said volume control module.

34. The volume control module of claim 20, wherein said pressure sensing means also functions to measure the pressure inside said main unit housing and generate output signals indicative of the measured main unit housing pressure.

35. The volume control module of claim 34, wherein said pressure sensing means also functions to measure the pressure of the fluid input through said intake valve and generate output signals indicative of the measured input fluid pressure.

36. The volume control module of claim 35, wherein said pressure sensing means comprises separate first, second, and third pressure sensing means, said first pressure sensing means measuring the pressure of the air input through said intake valve and generating output signals indicative of the measured input air pressure, said second pressure sensing means measuring ambient pressure externally of said volume control module and generating output signals indicative of the measured ambient pressure, and said third pressure sensing means measuring the pressure inside said main unit housing and generating output signals indicative of the measured main unit housing pressure.

37. The volume control module of claim 36, wherein said first, second, and third pressure sensing means are pressure transducers.

38. The volume control module of claim 36, wherein said control means includes means for calculating the buoyancy chamber volume necessary to achieve neutral buoyancy after moving from a starting depth to a new depth, based on the equation:

$$V1=(\text{change in buoyancy chamber volume})/(1-P1/P2),$$

where:

V1 is the buoyancy chamber volume necessary to achieve neutral buoyancy,

P1 is the absolute pressure at the starting depth as measured by said second pressure sensing means, and P2 is the absolute pressure at the new depth; and wherein said control means performs the function of measuring the change in buoyancy chamber volume while controlling said intake and vent valves during the process of setting neutral buoyancy.

39. The volume control module of claim 35, wherein said control means includes means for computing the volume of fluid passing through said intake and vent valves based on known variables.

40. The volume control module of claim 20, further comprising sensing means for indicating when fluid in the buoyancy chamber is away from said first opening.

41. The volume control module of claim 20, further comprising sensing means for indicating when the buoyancy compensator device is at an angle when fluid in the buoyancy chamber is away from said first opening.

42. The volume control module of claim 20, further comprising volume measuring means for measuring the volume of fluid passing through said intake and vent valves and generating output signals indicative of the measured volume of fluid, wherein said control means also functions to control operation of said intake and vent valves in response to the output signals received from said volume measuring means.

43. A method for controlling the volume of fluid in a buoyancy chamber of a buoyancy compensator device, comprising:

(a) providing a volume control module including a first opening connectable to a buoyancy compensator device having a buoyancy chamber, a second opening connectable to a hose assembly, an intake valve configured for connection to a source of low pressure fluid, and a vent valve for venting fluid from the buoyancy chamber;

(b) selecting one of a plurality of buoyancy-control functions to be carried out by the volume control module;

(c) measuring the pressure of air input through the intake valve and generating an output signal indicative of the measured input air pressure;

(d) measuring ambient pressure externally of the volume control module and generating an output signal indicative of the measured ambient pressure;

(e) measuring the pressure inside the volume control module and generating an output signal indicative of the measured main unit housing pressure;

(f) controlling operation of the intake and vent valves in response to the selection of a function in said step (b) and the output signals generated in said steps (c), (d), and (e).

44. The method of claim 27, wherein said step (b) comprises selecting a neutral buoyancy function after moving from a starting depth to a new depth, and wherein said method further includes the steps of:

(g) measuring the change in buoyancy chamber volume during said step (f); and (h) calculating the buoyancy chamber volume necessary to achieve neutral buoyancy using the change in buoyancy chamber volume measured in said step (g), based on the equation:

$$V1=(\text{change in buoyancy chamber volume})/(1-P1/P2),$$

where: V1 is the buoyancy chamber volume necessary to achieve neutral buoyancy,

P1 is the absolute pressure at the starting depth as measured during said step (d), and P2 is the absolute pressure at the new depth.

* * * * *